US012252869B2

(12) United States Patent
Kanazawa et al.

(10) Patent No.: US 12,252,869 B2
(45) Date of Patent: Mar. 18, 2025

(54) WORK MACHINE

(71) Applicant: HITACHI CONSTRUCTION MACHINERY CO., LTD., Tokyo (JP)

(72) Inventors: Akira Kanazawa, Tokyo (JP); Hidekazu Moriki, Tokyo (JP); Shinya Imura, Tsuchiura (JP); Shiho Izumi, Tsuchiura (JP); Takaaki Chiba, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 531 days.

(21) Appl. No.: 17/297,007

(22) PCT Filed: Feb. 12, 2020

(86) PCT No.: PCT/JP2020/005257

§ 371 (c)(1),
(2) Date: May 26, 2021

(87) PCT Pub. No.: WO2020/195262

PCT Pub. Date: Oct. 1, 2020

(65) Prior Publication Data

US 2022/0049474 A1 Feb. 17, 2022

(30) Foreign Application Priority Data

Mar. 22, 2019 (JP) ..... 2019-055445

(51) Int. Cl.
*E02F 9/26* (2006.01)
*E02F 3/43* (2006.01)

(52) U.S. Cl.
CPC ..... *E02F 9/262* (2013.01); *E02F 3/435* (2013.01)

(58) Field of Classification Search
CPC ..... E02F 9/262; E02F 3/435; E02F 3/3681; E02F 9/2203; E02F 9/2285; E02F 9/2296; E02F 3/43
See application file for complete search history.

(56) References Cited

U.S. PATENT DOCUMENTS

2011/0153170 A1* 6/2011 Dishman ..... E02F 9/2029 701/50
2014/0142817 A1 5/2014 Matsuyama
(Continued)

FOREIGN PATENT DOCUMENTS

CN 108699799 A 10/2018
EP 3 882 400 A1 9/2021
(Continued)

OTHER PUBLICATIONS

Machine Translation JP 2018194056 (Year: 2018).*
(Continued)

*Primary Examiner* — Jean Paul Cass
*Assistant Examiner* — Lidia Kwiatkowska
(74) *Attorney, Agent, or Firm* — MATTINGLY & MALUR, PC

(57) ABSTRACT

To provide a work machine that enables enhancement of shaping accuracy near a boundary line between two adjacent target surfaces. A controller 10 extracts, from among a plurality of target surfaces, a second target surface S2 that is a target surface adjacent to a first target surface S1, calculates a boundary line L2 between the first target surface S1 and the second target surface S2, and, prior to a work tool 6 passing the first boundary line L2, corrects a control signal for a posture control actuator 6*c* such that the angular difference $E_L$ between a reference line L1 set on the work tool 6 and the boundary line L2 becomes small.

6 Claims, 20 Drawing Sheets

(56) References Cited

U.S. PATENT DOCUMENTS

| | | | | |
|---|---|---|---|---|
| 2017/0268198 | A1* | 9/2017 | Shimano | E02F 3/32 |
| 2017/0284057 | A1* | 10/2017 | Moriki | E02F 9/2041 |
| 2018/0016768 | A1 | 1/2018 | Izumikawa | |
| 2019/0119886 | A1 | 4/2019 | Izumi et al. | |
| 2021/0010226 | A1* | 1/2021 | Tanaka | E02F 9/2033 |
| 2021/0262190 | A1* | 8/2021 | Ito | E02F 3/437 |

FOREIGN PATENT DOCUMENTS

| | | | | | |
|---|---|---|---|---|---|
| JP | 4460123 | B2 | | 5/2010 | |
| JP | 4477209 | B2 | | 6/2010 | |
| JP | 2018194056 | A | * | 12/2018 | B25J 11/00 |
| WO | 2016158779 | | | 10/2016 | |

OTHER PUBLICATIONS

Chinese Office Action received in corresponding Chinese Application No. 202080011079.1 dated May 23, 2022.
Extended European Search Report received in corresponding European Application No. 20776723.7 dated Dec. 9, 2022.
International Search Report of PCT/JP2020/005257 dated Apr. 7, 2020.
International Preliminary Report on Patentability received in corresponding International Application No. PCT/JP2020/005257 dated Oct. 7, 2021.

* cited by examiner

WORK MACHINE

TECHNICAL FIELD

The present invention relates to a work machine such as a hydraulic excavator.

BACKGROUND ART

Attendant on coping with computer aided construction, work machines such as a hydraulic excavator include those having a machine control function of controlling the position and posture of work mechanisms such as a boom, an arm and a bucket to move along a design surface. As a typical one of them, there has been known a work machine that, when a bucket tip approaches the design surface, limits the motion of the work mechanism such that the bucket tip does not move toward the design surface any more.

In public works construction management standards, standard values for allowable accuracy in the height direction of the design surface are determined. When an error in the formed shape of the design surface exceeds a tolerance, the construction must be conducted again, and thus work efficiency is lowered. Therefore, the machine control function is demanded to have a control accuracy necessary for satisfying the allowable accuracy of the formed shape.

On the other hand, in recent years, a rotary tilt bucket permitting two axes (tilt axis, rotary axis) perpendicular to a rotational axis of a bucket to be rotated relative to an arm has spread. A work machine having the rotary tilt bucket can set the posture of the bucket along a slope (inclined surface) which a track structure is difficult to face, and, therefore, the number of kinds of the design surfaces which can be shaped by such a work machine is largely increased as compared to the conventional work mechanisms. However, since the number of actuators which must be operated simultaneously by the operator is increased, there is a problem that lever operation at the time of a shaping work is difficult.

In addition, attendant on the spreading of the rotary tilt bucket, a machine control function of assisting a rotational operation around the tilt axis has started to spread. With the tilt operation assisted in addition to the assisting of the conventional boom, arm and bucket operations, a shaping work including a tilt operation can be performed with high accuracy by an operator with low proficiency. As an example of technology for assisting the operator's tilt operation, Patent Document 1 discloses a method of controlling the tilt rotary axis of a rotary tilt bucket. The controller of an excavator described in Patent Document 1 adjusts the tilt angle of the bucket by automatic control such that the bucket line defined on the bucket and the gradient of the design surface become parallel with each other.

PRIOR ART DOCUMENT

Patent Document

Patent Document 1: WO2016/158779

SUMMARY OF THE INVENTION

Problem to be Solved by the Invention

The design surface includes a plurality of surfaces for which normal directions are largely different, thus, during one shaping motion, the bucket may pass a plurality of successive surfaces. In the case of performing a shaping work while the bucket passes from one surface to the next surface, the bucket should keep a line contact state relative to the next surface, in order that the formed shape accuracy is maintained even after the surface is changed over.

However, the controller as described in Patent Document 1 has a problem that when the bucket passes from one surface to the next surface, the bucket and the next surface may be temporarily in a point contact state. As a result, since the start of the control of the posture of the bucket relative to the next surface is delayed, there is a fear that the shaping accuracy near the boundary line may be lowered. In addition, in shaping near the boundary line, it is necessary to match the posture of the bucket relative to the surface after passing the boundary line and to move the bucket so as to return toward the boundary line which the bucket has once passed, and, therefore, efficiency of the shaping work is lowered.

The present invention has been made in consideration of the above-mentioned problems. It is an object of the present invention to provide a work machine that enables enhancement of shaping accuracy near a boundary line between two adjacent target surfaces by keeping a line contact state between a work tool and each target surface when the work tool passes the boundary line.

Means for Solving the Problem

In order to achieve the above object, the present invention provides a work machine including: a work tool; a plurality of actuators including at least one position control actuator that controls a position of the work tool and at least one posture control actuator that controls the posture of the work tool; an operation device that instructs the plurality of actuators about operations of the actuators; a controller that outputs a control signal for controlling at least one of the plurality of actuators on the basis of an operation amount of the operation device; and a design surface storage device that stores information concerning design surfaces including a plurality of target surfaces, the controller is configured to extract a first target surface which is a target surface nearest to the work tool, from among the plurality of target surfaces, and control an operation velocity of at least one actuator of the plurality of actuators on the basis of the position and posture of the work tool relative to the first target surface. In the work machine, the controller is configured to extract a second target surface which is a target surface adjacent to the first target surface, from the plurality of target surfaces, calculate a first boundary line which is a boundary line between the first target surface and the second target surface, and, prior to the work tool passing the first boundary line, correct a control signal for the posture control actuator such that the angular difference between a reference line set on the work tool and the first boundary line becomes small.

According to the present invention configured as above, the angular difference between the reference line set on the work tool and the boundary line between the two adjacent target surfaces is calculated, and, prior to the work tool passing the boundary line, the posture of the work tool is controlled such that the angular difference between the reference line and the boundary line becomes small. As a result, when the work tool passes the boundary line, the line contact state between the work tool and each target surface is maintained, and, therefore, shaping accuracy in the vicinity of the boundary line can be enhanced.

Advantages of the Invention

According to the work machine according to the present invention, when the work tool passes the boundary line between two adjacent target surfaces, the line contact state between the work tool and each target surface is maintained, and, therefore, shaping accuracy near the boundary line can be enhanced.

MODES FOR CARRYING OUT THE INVENTION

Figure 1:
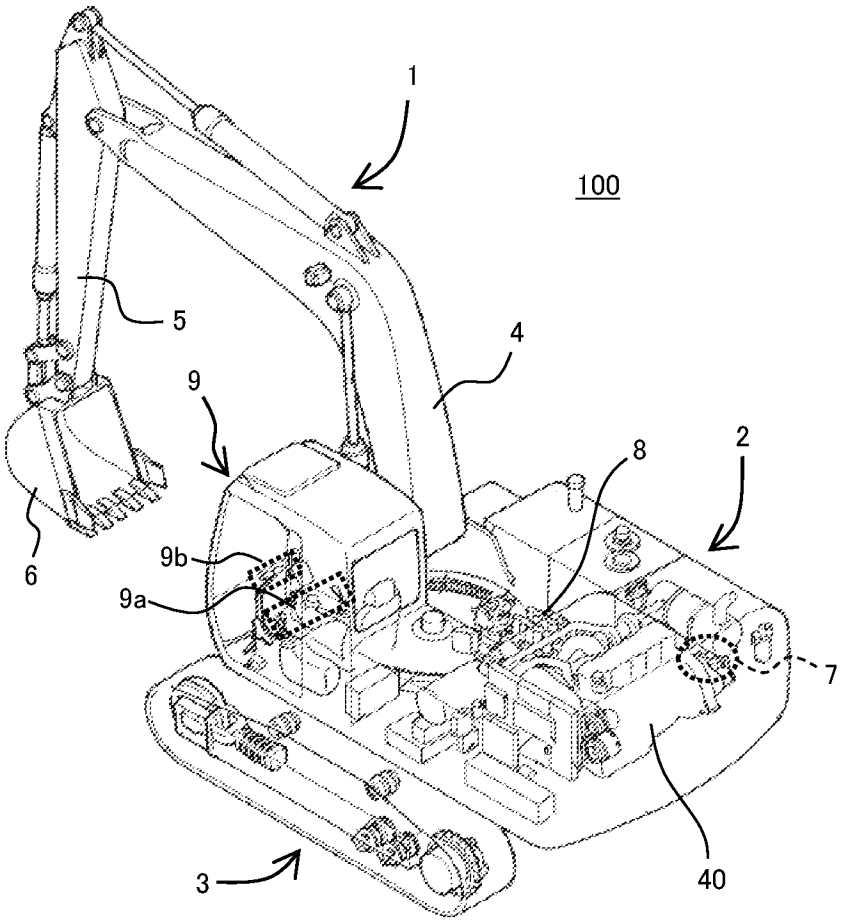
FIG. 1 is a diagram schematically depicting an external appearance of a hydraulic excavator according to a first embodiment of the present invention.

Embodiments of the present invention will be described below using the drawings and the like. The following description shows specific examples of the contents of the present invention, and the present invention is not limited to the description, and various modifications and corrections by those skilled in the art are possible with the scope of the technical thought disclosed herein. In addition, in all the drawings for describing the present invention, the parts having the same functions are denoted by the same reference characters, and repeated descriptions thereof may be omitted.

Embodiment 1

FIG. 1 is a diagram schematically depicting an external appearance of a hydraulic excavator 100 according to a first embodiment of the present invention.

In FIG. 1, the hydraulic excavator 100 includes an articulated front device (front work implement) 1 configured by connecting a plurality of rotating driven members (a boom 4, an arm 5, and a bucket (work tool) 6), and an upper swing structure 2 and a lower track structure 3 that constitute a machine body, with the upper swing structure 2 being provided swingably relative to the lower track structure 3. In addition, a base end of the boom 4 of the front device 1 is rotatably supported on a front portion of the upper swing structure 2, one end of the arm 5 is rotatably supported on an end portion (tip end) different from the base end of the boom 4, and the bucket 6 is rotatably supported on the other end of the arm 5.

An operation lever device (operation device) 9*a* that outputs operation signals for operating hydraulic actuators 2*a*, 4*a* to 6*a*, 6*b*, and 6*c* (depicted in FIG. 2) and an operation lever device (operation device) 9*b* that outputs an operation signal for driving a track motor 3*a* are provided in a cab 9 in which the operator rides. The operation lever device 9*a* is two operation levers that can be inclined in the front-rear directions and the left-right directions, and operates the hydraulic actuators 2*a* and 4*a* to 6*a* according to the inclination direction and the inclination amount. In addition, the operation lever device 9*a* includes two physical switches capable of outputting continuous signals, and outputs electrical signals for operating the hydraulic actuators 6*b* and 6*c*. The operation lever device 9*b* is two operation levers that can be inclined in the front-rear directions, and operates the hydraulic actuator 3*a* according to the inclination direction and the inclination amount. The operation lever devices 9*a* and 9*b* include sensors that electrically detect operation signals corresponding to the inclination amounts of the operation levers (lever operation amounts), and output the detected lever operation amounts to a controller 10 (depicted in FIG. 3), which is a controller, through electric wiring.

Control of operations of the hydraulic actuators 2*a* to 6*a*, 6*b*, and 6*c* is performed by controlling, by a control valve 8, the directions and flow rates of a hydraulic working oil supplied from a hydraulic pump 7 driven by a prime mover 40 to each of the hydraulic actuators 2*a* to 6*a*, 6*b*, and 6*c*.

The control of the control valve 8 is performed by a driving signal (pilot pressure) outputted from a pilot pump 70 (depicted in FIG. 3) through a solenoid proportional valve. On the basis of the electrical signals of the operation lever operation amounts detected by the operation lever devices 9*a* and 9*b*, the solenoid proportional valve is controlled by the controller 10, whereby the operation of each of the hydraulic actuators 2*a* to 6*a*, 6*b* and 6*c* is controlled.

Note that the operation lever devices 9*a* and 9*b* may be of a hydraulic pilot system different from the aforementioned, and pilot pressures according to the operation directions and the operation amounts of the operation levers may be supplied directly to the control valve 8 as driving signals, thereby to drive each of the hydraulic actuators 2*a* to 6*a*.

Figure 2:
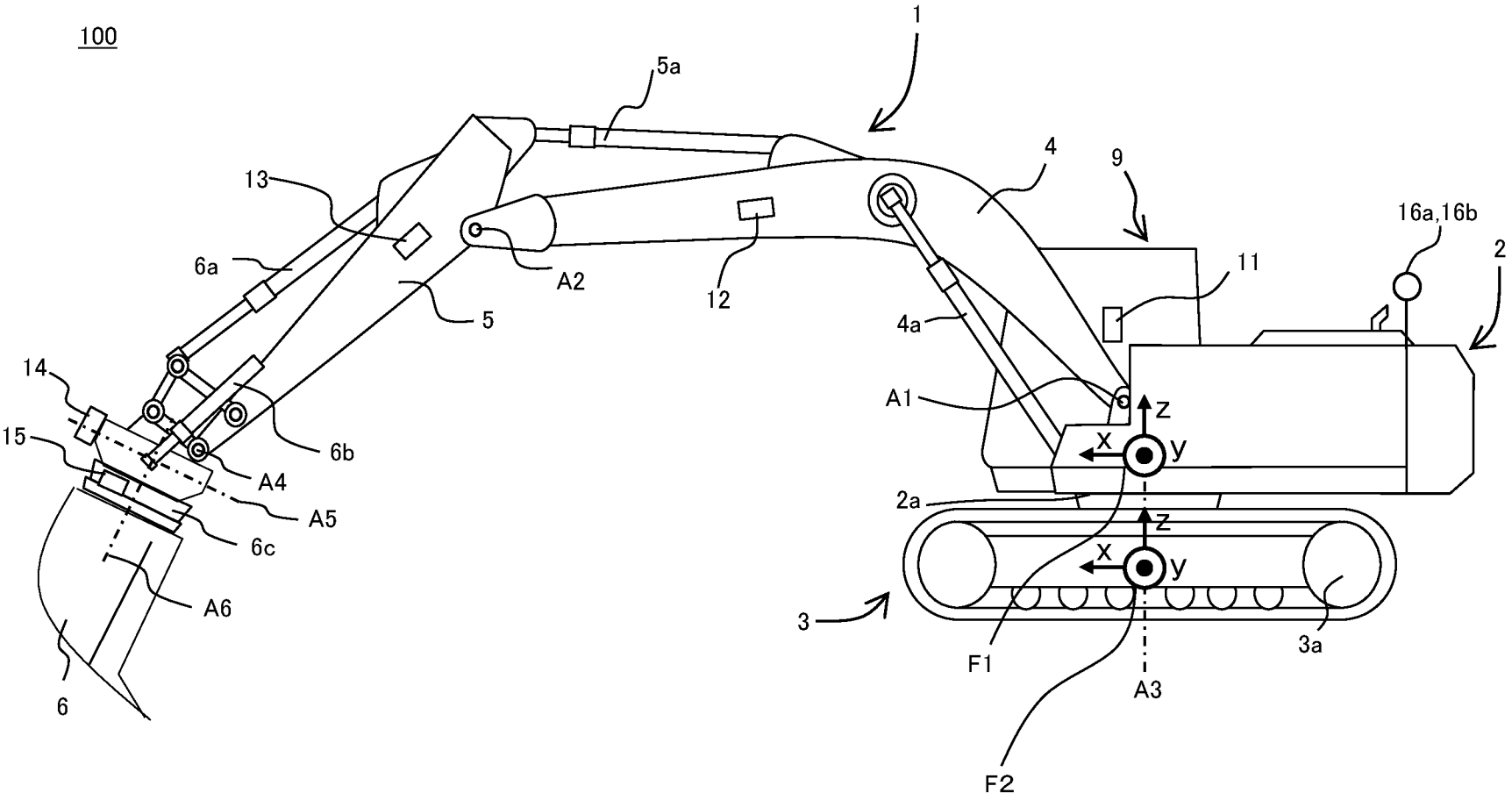
FIG. 2 is a diagram schematically depicting a driving mechanism of the hydraulic excavator according to the first embodiment of the present invention.

FIG. 2 is a diagram schematically depicting a driving mechanism of the hydraulic excavator 100.

For the hydraulic excavator 100, two coordinate systems of a coordinate system F1 fixed to the upper swing structure 2 and a coordinate system F2 fixed to the lower track structure 3 are defined. The coordinate system F1 and the coordinate system F2 are the same in a z-axis direction, and have origin positions offset from each other in the z-axis direction.

The boom 4 and the arm 5 are operated on a single plane (hereinafter referred to as operating plane) by driving of a boom cylinder 4*a* and an arm cylinder 5*a*. The operating plane is a plane orthogonal to a rotational axis A1 of the boom 4 and a rotational axis A2 of the arm 5, and is defined as an x-z plane of the upper swing structure coordinate system F1. The operating plane is rotated according to a swing operation of the upper swing structure 2, with the swing motor 2*a* rotated around a rotational axis A3.

As for the bucket 6, the posture of the bucket 6 can be controlled in a rolling direction, a pitching direction and a yawing direction by driving of a bucket cylinder 6*a*, a tilt cylinder 6*b* and a rotary motor 6*c*. Here, the rolling direction is defined as a rotating direction around the X axis of the upper swing structure coordinate system F1, the pitching direction is defined as a rotating direction around the Y axis of the upper swing structure coordinate system F1, and the yawing direction is defined as a rotating direction around the Z axis of the upper swing structure coordinate system F1. By the driving of the bucket cylinder 6*a*, the bucket 6 is rotated in the rolling direction around a rotational axis A4. By the driving of the tilt cylinder 6*b*, the bucket 6 is rotated in the pitching direction around a rotational axis A5. By the driving of the rotary motor 6*c*, the bucket 6 is rotated in the yawing direction around a rotational axis A6.

Inertia measuring units 11 to 14 are for measuring angular velocities and accelerations. A machine body inertia measuring unit 11, a boom inertia measuring unit 12, an arm inertia measuring unit 13 and a bucket inertia measuring unit 14 presume rotational angles and angular velocities around the rotational axes A1 to A5, on the basis of the measured angular velocities and accelerations. A rotary angle measuring device 15 measures rotational angle around the rotational axis A6. Note that the angle detecting means are not limited to the inertia measuring units 11 to 14; for example, stroke sensors may be disposed respectively on the boom cylinder 4*a*, the arm cylinder 5*a*, the bucket cylinder 6*a* and the tilt cylinder 6*b*, and the rotational angles may be calculated by a transformation based on the correlation between the rotational amounts around the rotational axes A1, A2, A4, and A5 and cylinder stroke amounts.

For acquiring machine body position Pg and machine body orientation Cg, two Global Navigation Satellite System (GNSS) antennas 16*a* and 16*b* are attached to the upper swing structure 2. The GNSS antennas 16*a* and 16*b* transmit distance signals received from satellites or the like to a positioning device 200 which will be described later.

Figure 3:
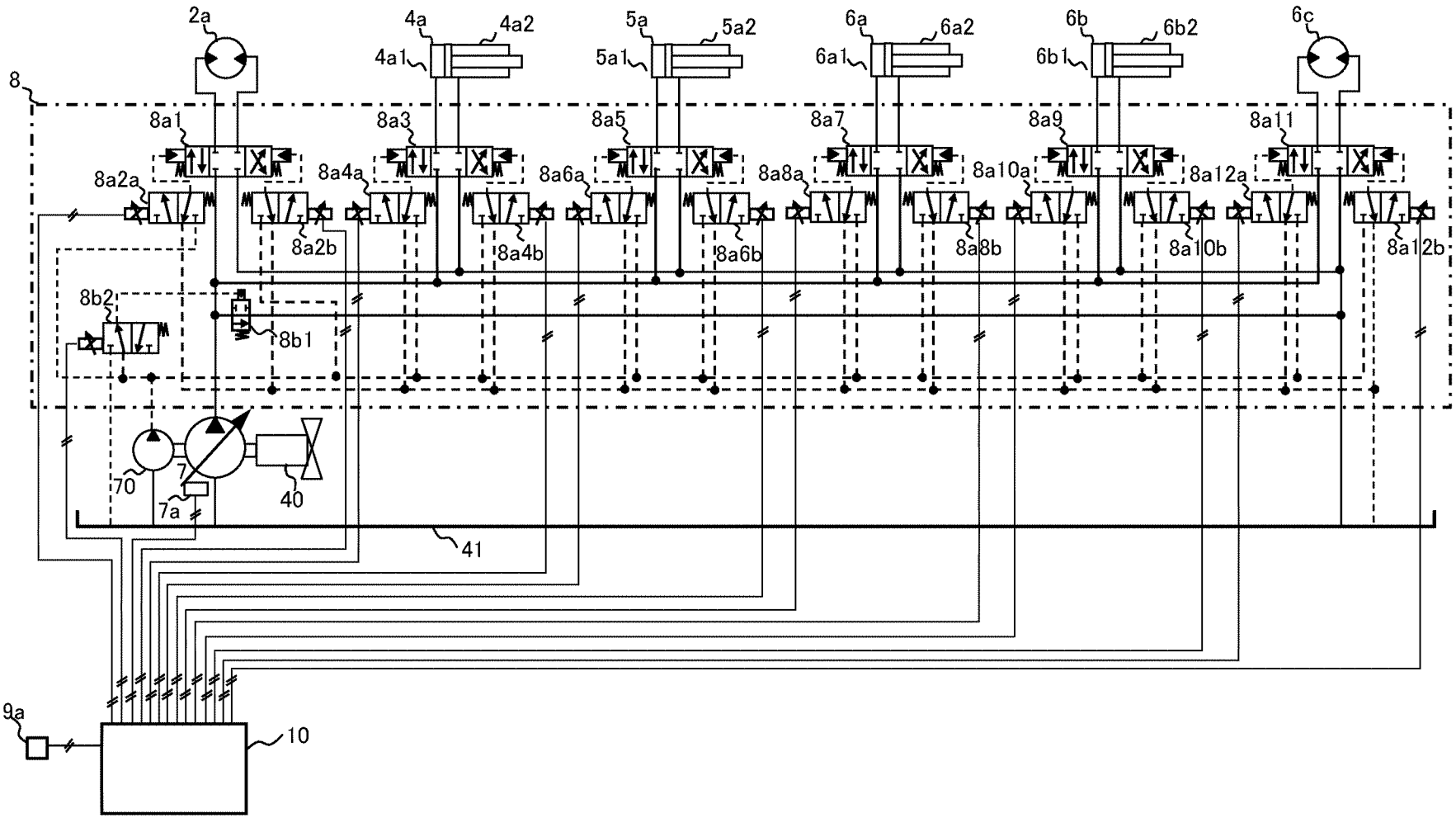
FIG. 3 is a hydraulic circuit diagram schematically depicting an hydraulic actuator control system mounted on the hydraulic excavator according to the first embodiment of the present invention.

FIG. 3 is a diagram schematically depicting a hydraulic actuator control system mounted on the hydraulic excavator 100. For simplification of description, only elements necessary for explanation of the invention are described.

The hydraulic actuator control system includes the control valve 8 that drives each of the hydraulic actuators 2*a* to 6*a*, 6*b*, and 6*c*, a hydraulic pump 7 that supplies a hydraulic working oil to the control valve 8, a pilot pump 70 that supplies a pilot pressure serving as a driving signal for the control valve 8, and a prime mover 40 for driving the hydraulic pump 7. In the present embodiment, the hydraulic pump 7 is of a variable displacement type, the displacement of the hydraulic pump 7 is adjusted by an operation of a variable displacement pump solenoid proportional pressure reducing valve 7*a* based on a current command from the controller 10, whereby the delivery flow rate of the hydraulic pump 7 is controlled. Note that the hydraulic pump 7 may be of a fixed displacement type, and the rotating velocity of the prime mover 40 may be adjusted by a control command from the controller 10, thereby to control the delivery flow rate of the hydraulic pump 7.

The hydraulic working oil delivered by the hydraulic pump 7 is distributed by a swing directional control valve 8*a*1, a boom directional control valve 8*a*3, an arm directional control valve 8*a*5, the bucket directional control valve 8*a*7, a tilt directional control valve 8*a*9 and a rotary directional control valve 8*a*11 to the corresponding hydraulic actuators 2*a* to 6*a*, 6*b*, and 6*c*. On the basis of the current commands from the controller 10, solenoid proportional pressure reducing valves 8*a*2*a*, 8*a*2*b*, 8*a*4*a*, 8*a*4*b*, 8*a*6*a*, 8*a*6*b*, 8*a*8*a*, 8*a*8*b*, 8*a*10*a*, 8*a*10*b*, 8*a*12*a*, and 8*a*12*b* are operated, whereby pilot pressures for driving directional control valves 8*a*1, 8*a*3, 8*a*5, 8*a*7, 8*a*9, and 8*a*11 are adjusted.

In regard of the swing directional control valve 8*a*1, one of the lines connected to the swing motor 2*a* becomes an opening communicating with the hydraulic pump 7 (meter-in opening), whereas the other one becomes an opening communicating with a line connected to the tank 41 (meter-out opening). By selecting which one of the solenoid proportional pressure reducing valve 8*a*2*a* and the solenoid proportional pressure reducing valve 8*a*2*b* is to be driven, the direction of the hydraulic working oil flowing inside the swing motor 2*a* is reversed, whereby the rotating direction of the swing motor 2*a* can be controlled. The rotary directional control valve 8*a*11 also has a similar configuration, and, therefore, description thereof is omitted.

In regard of the boom directional control valve 8*a*3, one of a bottom-side oil chamber 4*a*1 and a rod-side oil chamber 4*a*2 of the boom cylinder 4*a* becomes an opening communicating with a line connected to the hydraulic pump 7 (meter-in opening), whereas the other one becomes an opening communicating with a line connected to the tank 41 (meter-out opening). When the solenoid proportional pressure reducing valve 8*a*4*a* is driven, the hydraulic working oil flows from the hydraulic pump 7 into the bottom-side oil chamber 4*a*1, and the hydraulic working oil in the rod-side oil chamber 4*a*2 is returned to the tank 41. On the other hand, when the solenoid proportional pressure reducing valve 8*a*4*b* is driven, the hydraulic working oil flows from the hydraulic pump 7 into the rod-side oil chamber 4*a*2, and the hydraulic working oil in the bottom-side oil chamber 4*a*1 is returned to the tank 41. In this way, by selecting which one of the solenoid proportional pressure reducing valve 8*a*4*a* and the solenoid proportional pressure reducing valve 8a4b is to be driven, the operating direction of the boom cylinder 4a is reversed, whereby the driving direction of the boom cylinder 4a can be controlled. The arm directional control valve 8a5, the bucket directional control valve 8a7 and the tilt directional control valve 8a9 have similar configurations, and, therefore, descriptions thereof are omitted.

Part of the hydraulic working oil delivered from the hydraulic pump 7 is discharged to the tank 41, with a bleed-off valve 8b1 providing communication with a line to the tank 41. The bleed-off valve 8b1 is adjusted in pilot pressure by an operation of a bleed-off valve solenoid proportional pressure reducing valve 8b2 based on a current command from the controller 10, whereby the flow rate of the hydraulic working oil discharged to the tank 41 is controlled. Note that in place of the placement of the bleed-off valve 8b1, the directional control valves 8a1, 8a3, 8a5, 8a7, 8a9, and 8a11 may be open center type directional control valves capable of opening control in three directions, and bleed-off opening may be adjusted in conjunction with meter-in opening and meter-out opening.

Figure 4:
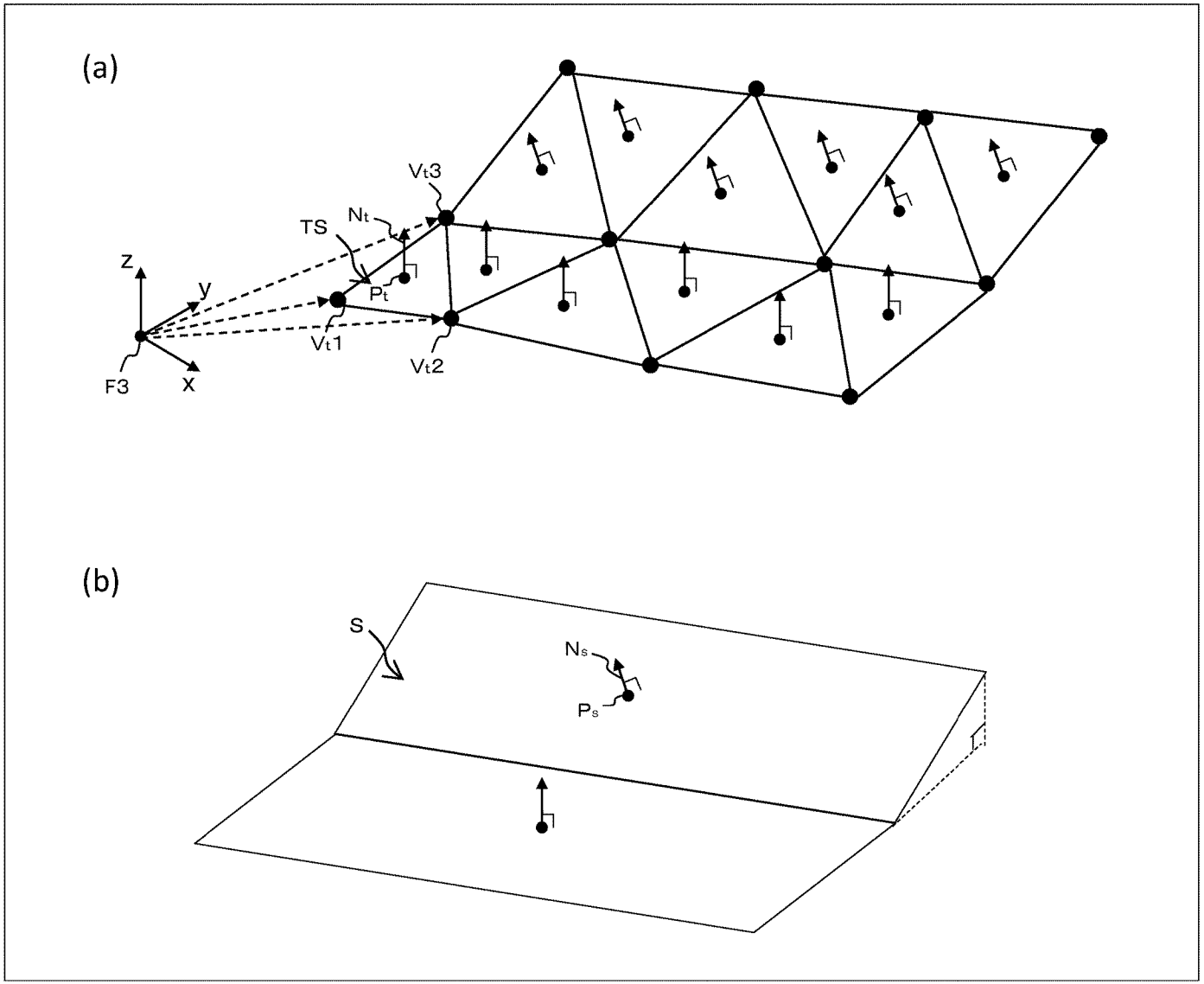
FIG. 4 is a diagram depicting the details of the definitions of a design surface and a target surface according to the first embodiment of the present invention.

FIG. 4 is a diagram depicting the details of the definitions of a design surface TS and a target surface S.

As illustrated in FIG. 4(*a*), the design surface TS is defined by three position coordinate points Vt1, Vt2, and Vt3 with a global coordinate system F3 set on the outside of the hydraulic excavator 100 as a reference. By combining a plurality of design surfaces TS expressed as triangles constituted of the three points Vt1, Vt2, and Vt3, a terrain profile which becomes a target of shaping work is expressed.

With respect to the design surface TS, a center of gravity position Pt of the triangle and a normal vector Nt are calculated. The center of gravity point Pt and the normal vector Nt are calculated for each of the design surfaces TS, and, as depicted in FIG. 4(*b*), the design surfaces TS with the angle formed between the normal vectors Nt small are collected into one, to be newly defined as a target surface S. The target surface S is expressed by reference positions $Ps=(Ps_x, Ps_y, Ps_z)$ with the global coordinate system F3 as a reference and three-dimensional normal vector $Ns=(Ns_x, Ns_y, Ns_z)$ for which Euclidean norm with the global coordinate system F3 as a reference is 1.

Figure 5:
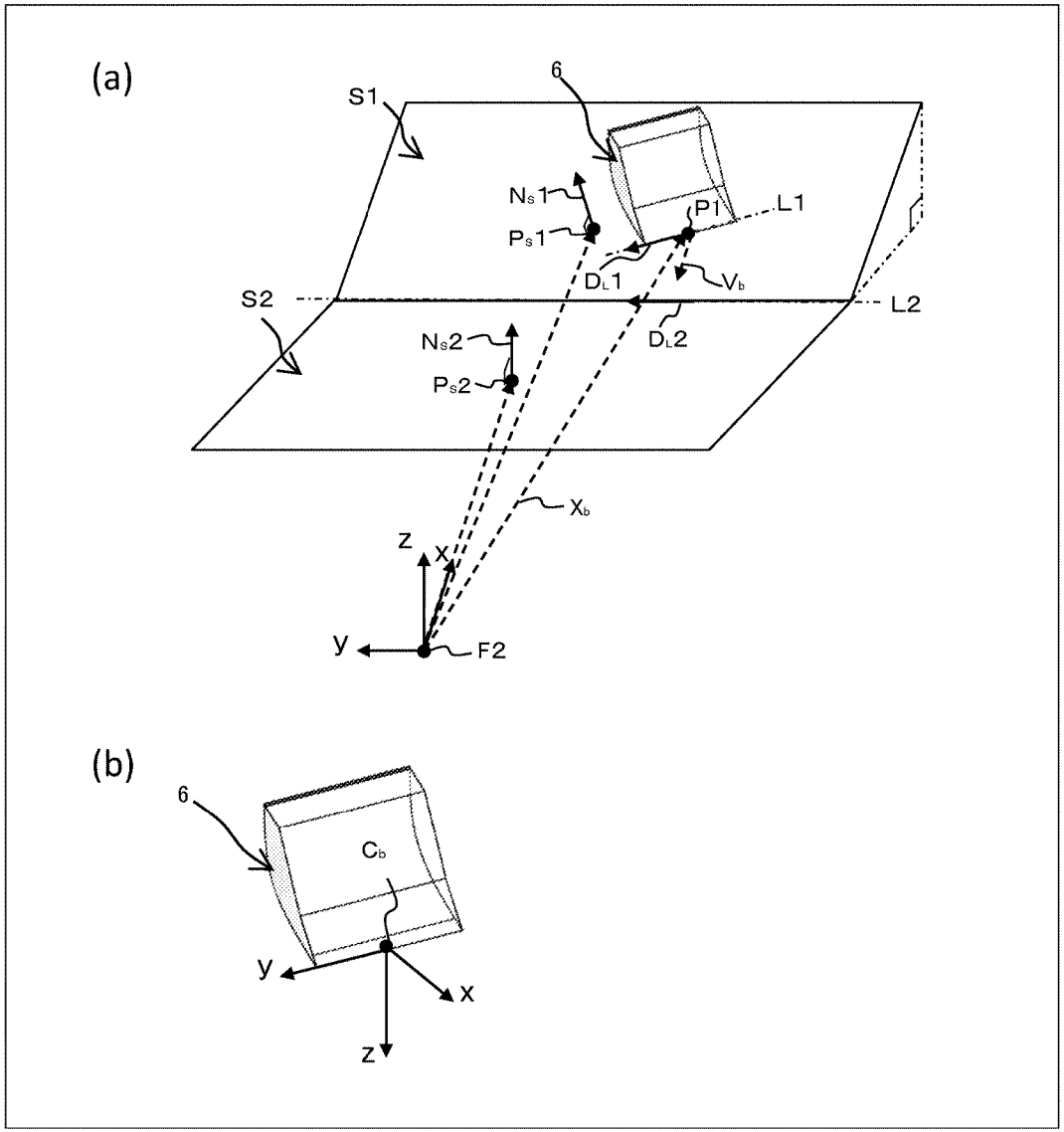
FIG. 5 is a diagram depicting the details of the definitions of a target surface according to the first embodiment of the present invention and a calculated value concerning a work tool.

FIG. 5 is a diagram depicting the details of the definition of calculated values concerning the target surfaces S1 and S2 and the work tool 6.

The state of the work tool 6 is constituted of position $X_b$, posture $C_b$, and translation velocity (moving velocity) $V_b$. The position $X_b$ is defined as a position of a reference point P1 of the work tool 6, with the lower track structure coordinate system F2 as a reference, and is constituted as $X_b=(p_x, p_y, p_z)$ from three elements of a position $p_x$ in the x direction, a position $p_y$ in the y direction, and a position $p_z$ in the z direction. The posture $C_b$ is defined as respective rotational angles in the rolling, pitching and yawing directions, with the lower track structure coordinate system F2 as a reference, is configured as $C_b=(\theta_r, \theta_p, \theta_y)$ from three elements of an angle $\theta_r$ in the rolling direction, an angle $\theta_p$ in the pitching direction, and an angle $\theta_y$ in the yawing direction, and is expressed as depicted in FIG. 5(*b*). The translation velocity $V_b$ is a translation velocity of the reference point P1 of the work tool 6, with the lower track structure coordinate system F2 as a reference, and is configured as $V_b=(v_x, v_y, v_z)$ from three elements of a velocity $v_x$ in the x direction, a velocity $v_y$ in the y direction, and a velocity $v_z$ in the z direction. Rotational velocities in the rolling, pitching and yawing directions are not used in the present embodiment, and are therefore omitted. Note that the translation velocity $V_b$ will hereinafter be referred to as "moving velocity $V_b$."

As depicted in FIG. 5(*a*), a reference line L1 is preliminarily set on the work tool 6. In the present embodiment, a cutting edge of the work tool 6 is defined as the reference line L1. Here, the reference line L1 is expressed by a three-dimensional direction vector $D_L\mathbf{1}=(D_L\mathbf{1}_x, D_L\mathbf{1}_y, D_L\mathbf{1}_z)$ for which Euclidean norm with the lower track structure coordinate system F2 as a reference is 1. Note that the direction $D_L\mathbf{1}$ of the reference line L1 in the present embodiment coincides with the y correction direction of the posture $C_b$ of the work tool 6.

The calculations concerning posture control of the work tool 6 is performed on the basis of the main target surface S1 and the predicted target surface S2. The main target surface S1 is defined as the target surface S for which the distance of a perpendicular drawn from the reference point P1 of the work tool 6 is the shortest. On the other hand, the predicted target surface S2 is defined as the target surface S which is in the moving direction $V_b$ of the work tool 6 and for which the distance of a perpendicular drawn from the reference point P1 to the boundary line with the main target surface S1 is the shortest. It is to be noted, however, that when the Euclidean norm of the moving velocity $V_b$ of the work tool 6 is smaller than a threshold $V_{b,\ th}$, the target surface S for which the distance of a perpendicular drawn from the reference point P1 to the boundary line with the main target surface S1 is the shortest is made to be the predicted target surface S2.

These two target surfaces S1 and S2 are calculated with the lower track structure coordinate system F2 as a reference. The conversion from the global coordinate system F3 with which the calculation concerning the target surfaces S is performed to the lower track structure coordinate system F2 with which the calculation concerning the target surfaces S1 and S2 is performed is performed on the basis of the machine body position Pg and the machine body orientation Cg acquired from the positioning device 200 described later.

The main target surface S1 is expressed by a reference position $P_S\mathbf{1}=(P_S\mathbf{1}_x, P_S\mathbf{1}_y, P_S\mathbf{1}_z)$ with the lower track structure coordinate system F2 as a reference and a three-dimensional normal vector $N_S\mathbf{1}=(N_S\mathbf{1}_x, N_S\mathbf{1}_y, N_S\mathbf{1}_x)$ for which Euclidean norm with the lower track structure coordinate system F2 as a reference is 1. Similarly, the predicted target surface S2 is expressed by a reference position $P_S\mathbf{2}=(P_S\mathbf{2}_x, P_S\mathbf{2}_y, P_S\mathbf{2}_x)$ with the lower track structure coordinate system F2 as a reference and a three-dimensional normal vector $N_S\mathbf{2}=(N_S\mathbf{2}_x, N_S\mathbf{2}_y, N_S\mathbf{2}_x)$ for which Euclidean norm with the lower track structure coordinate system F2 as a reference is 1.

In addition, a boundary line L2 between the target surfaces S1 and S2 is calculated from the main target surface S1 and the predicted target surface S2. The boundary line L2 is expressed by a three-dimensional direction vector $D_L\mathbf{2}=(D_L\mathbf{2}_x, D_L\mathbf{2}_y, D_L\mathbf{2}_z)$ for which Euclidean norm with the lower track structure coordinate system F2 as a reference is 1. The direction vector $D_L\mathbf{2}$ is calculated as a vector product between the normal vector $N_S\mathbf{1}$ of the main target surface S1 and the normal vector $N_S\mathbf{2}$ of the predicted target surface S2, in the manner of the following formula (1).

[Math 1]

$$D_L2 = \frac{N_S1 \times N_S2}{|N_S1 \times N_S2|} \quad (1)$$

Figure 6:
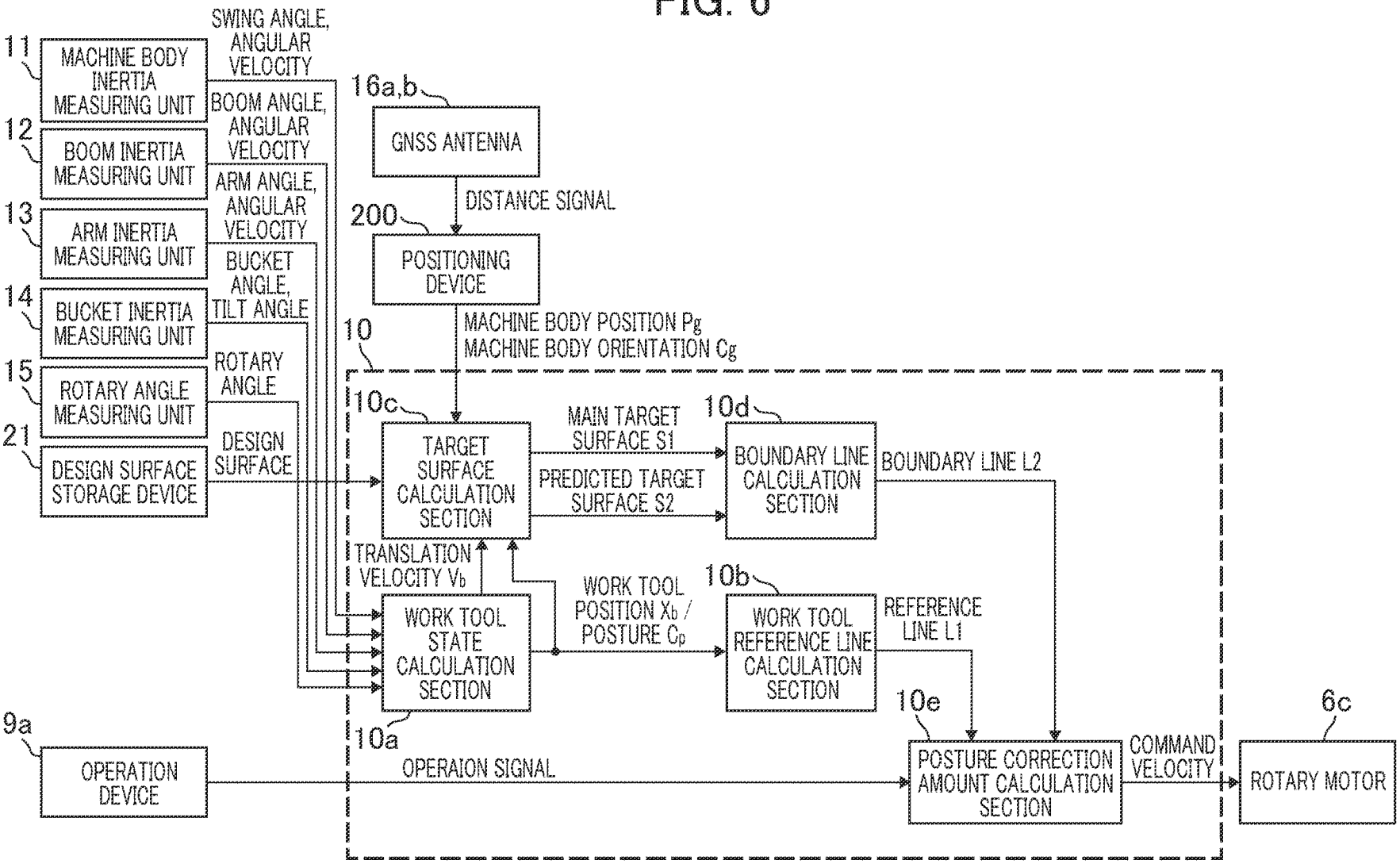
FIG. 6 is a functional block diagram depicting the details of processing functions of a controller according to the first embodiment of the present invention.

FIG. 6 is a functional block diagram depicting the details of processing functions of the controller 10 according to the present embodiment. Note that in FIG. 6, like in FIG. 3, functions not concerning directly to the present invention are omitted in description.

The controller 10 has a work tool state calculation section 10*a*, a work tool reference line calculation section 10*b*, a target surface calculation section 10*c*, a boundary line calculation section 10*d*, and a posture correction amount calculation section 10*e*.

The work tool state calculation section 10*a* geometrically calculate the position $X_b$, posture $C_b$ and moving velocity $V_b$ of the work tool 6 with the lower track structure coordinate system F2 as a reference, on the basis of the angles and angular velocities around the rotational axes A1 to A6 acquired from the measuring units 11 to 15. The position $X_b$ and the posture $C_b$ calculated are outputted to the work tool reference line calculation section 10*b* and the target surface calculation section 10*c*. The moving velocity $V_b$ is outputted to the target surface calculation section 10*c*.

The work tool reference line calculation section 10*b* calculates a direction vector $D_L$1 of the reference line L1 preset on the work tool 6, on the basis of the position $X_b$ and the posture $C_b$ calculated by the work tool state calculation section 10*a*. The reference line L1 thus calculated is outputted to the posture correction amount calculation section 10*e*.

The target surface calculation section 10*c* extracts the main target surface S1 and the predicted target surface S2 from among the design surfaces TS acquired from a design surface storage device 21, on the basis of the machine body position Pg and the machine body orientation Cg acquired from the positioning device 200, and the position $X_b$ and the moving velocity $V_b$ acquired from the work tool state calculation section 10*a*, and calculates the reference positions $P_S$1 and $P_S$2 and normal vectors $N_S$1 and $N_S$2 with the lower track structure coordinate system F2 as a reference. The calculated values concerning the main target surface S1 and the predicted target surface S2 calculated are outputted to the boundary line calculation section 10*d*.

The boundary line calculation section 10*d* calculates the direction vector $D_L$2 from the formula (1), on the basis of the calculated values concerning the main target surface S1 and the predicted target surface S2 acquired from the target surface calculation section 10. The calculated values of the boundary line L2 thus calculated are outputted to the posture correction amount calculation section 10*e*.

The posture correction amount calculation section 10*e* calculates a rotary command velocity $\omega_{y,\ ref}$ to be outputted to the rotary motor 6*c*, on the basis of the reference line L1 acquired from the work tool reference line calculation section 10*b*, the boundary line L2 acquired from the boundary line calculation section 10*d*, and the operation signal acquired from the operation device 9*a*.

In the present embodiment, the shaping work performed by controlling the position $X_b$ of the work tool 6 is performed by a manual operation of the operation device 9*a* by the operator. In this case, the operator manually controls the driving ratios of the swing motor 2*a*, the boom cylinder 4*a* and the arm cylinder 5*a*, to thereby perform the shaping work. Note that an excavation control system for semi-automatically controlling the swing motor 2*a*, the boom cylinder 4*a* and the arm cylinder 5*a* according to the operation signal of the operation device 9*a* and the main target surface S1 may be provided. Here, the excavation control system performs a control for forcibly operating at least one of the hydraulic actuators 2*a*, 4*a*, and 5*a* (for example, performs an operation of forcibly raising the boom by extending the boom cylinder 4*a*) such that the position $X_b$ of the work tool 6 is maintained on the main target surface S1 and a region on the upper side thereof and does not enter the lower side of the main target surface S1 in relation to the operation signal of the operation device 9*a*.

Figure 7:
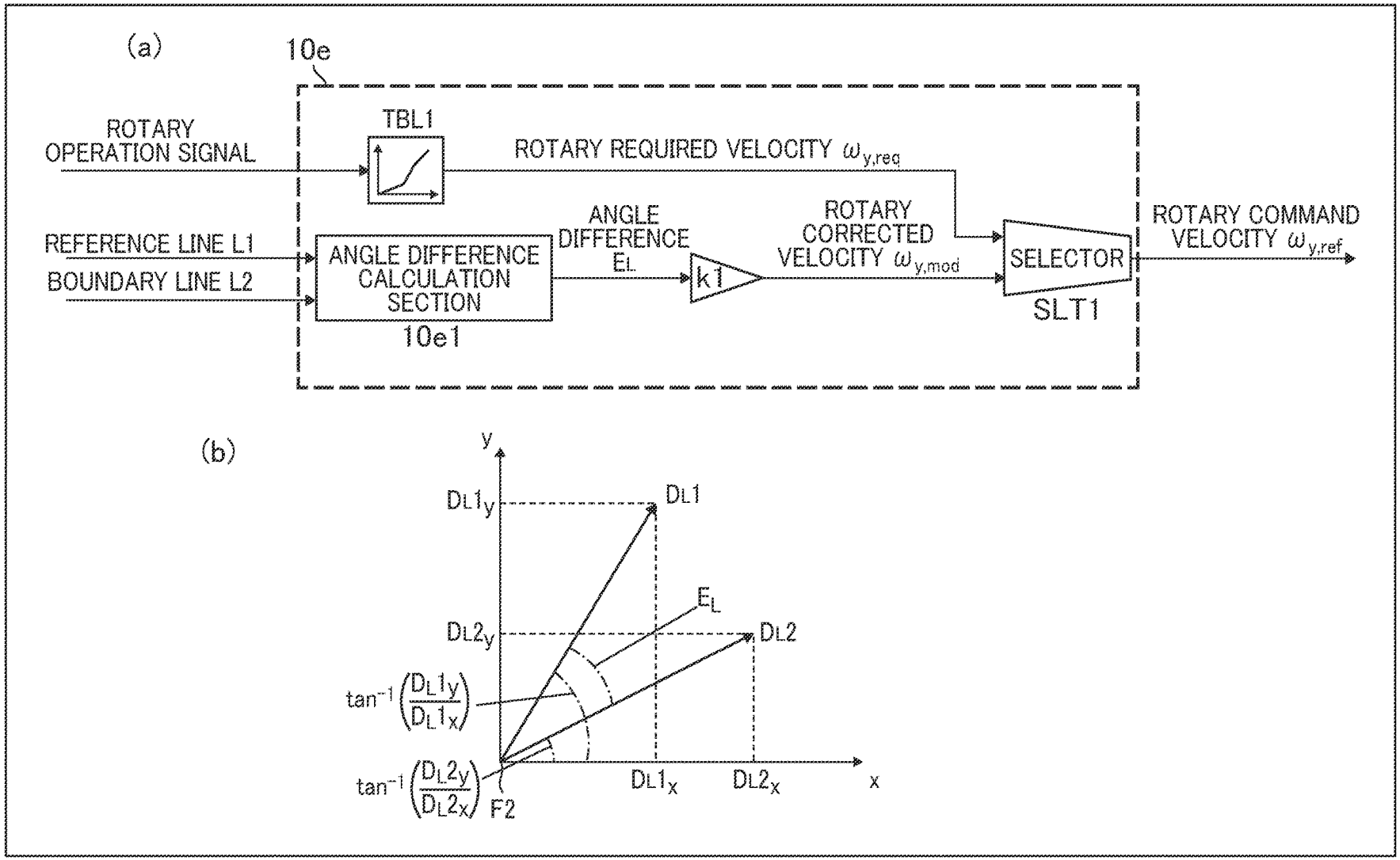
FIG. 7 is a functional block diagram depicting the details of processing functions of a posture correction amount calculation section according to the first embodiment of the present invention.

FIG. 7 is a functional block diagram depicting the details of a processing function of the posture correction amount calculation section 10*e*.

FIG. 7(*a*) is a functional block diagram depicting a processing flow of the posture correction amount calculation section 10*e*. The posture correction amount calculation section 10*e* has an angular difference calculation section 10*e*1 that calculates an angular difference $E_L$ between a reference line direction vector L1 and a boundary line direction vector L2. In the present embodiment, for determining whether the angular difference is positive or negative, the angular difference $E_L$ is calculated, for example, in the manner of the following formula (2).

[Math 2]

$$E_L = \tan^{-1}\left(\frac{D_L1_y}{D_L1_x}\right) - \tan^{-1}\left(\frac{D_L2_y}{D_L2_x}\right) \quad (2)$$

As depicted in FIG. 7(*b*), the angular difference $E_L$ is defined as an angular difference between the angle formed by the reference line direction vector $D_L$1 relative to the x axis of the lower track structure coordinate system F2 and the angle formed by the boundary line direction vector $D_L$2 relative to the x axis.

The rotary corrected velocity $\omega_{y,\ mod}$ is calculated as the following formula (3), on the basis of the angular difference $E_L$ calculated by the angular difference calculation section 10*e*1.

[Math 3]

$$\omega_{y,mod} = k_1 E_L \quad (3)$$

Here, $k_1$ is a gain representing the correction degree of the rotary motor 6*c* in relation to the angular difference $E_L$. A rotary required velocity $\omega_{y,\ req}$ obtained by conversion of the calculated rotary corrected velocity $\omega_{y,\ mod}$ and the rotary operation signal by a table TBL1 is inputted to the selector SLT1. The selector SLT1, where the rotary required velocity $\omega_{y,\ req}$ is given, outputs the rotary required velocity $\omega_{y,\ req}$ as a rotary command velocity $\omega_{y,\ ref}$. On the other hand, when the rotary required velocity $\omega_{y,\ req}$ is not given, the selector SLT1 outputs the rotary corrected velocity $\omega_{y,\ mod}$ as the rotary command velocity $\omega_{y,\ ref}$. When the rotary corrected velocity $\omega_{y,\ mod}$ is outputted as the rotary command velocity $\omega_{y,\ ref}$, rotation of the rotary motor 6*c* according to the magnitude and direction of the angular difference $E_L$ controls the posture $\theta_y$ in the yawing direction of the work tool 6.

Figure 8:
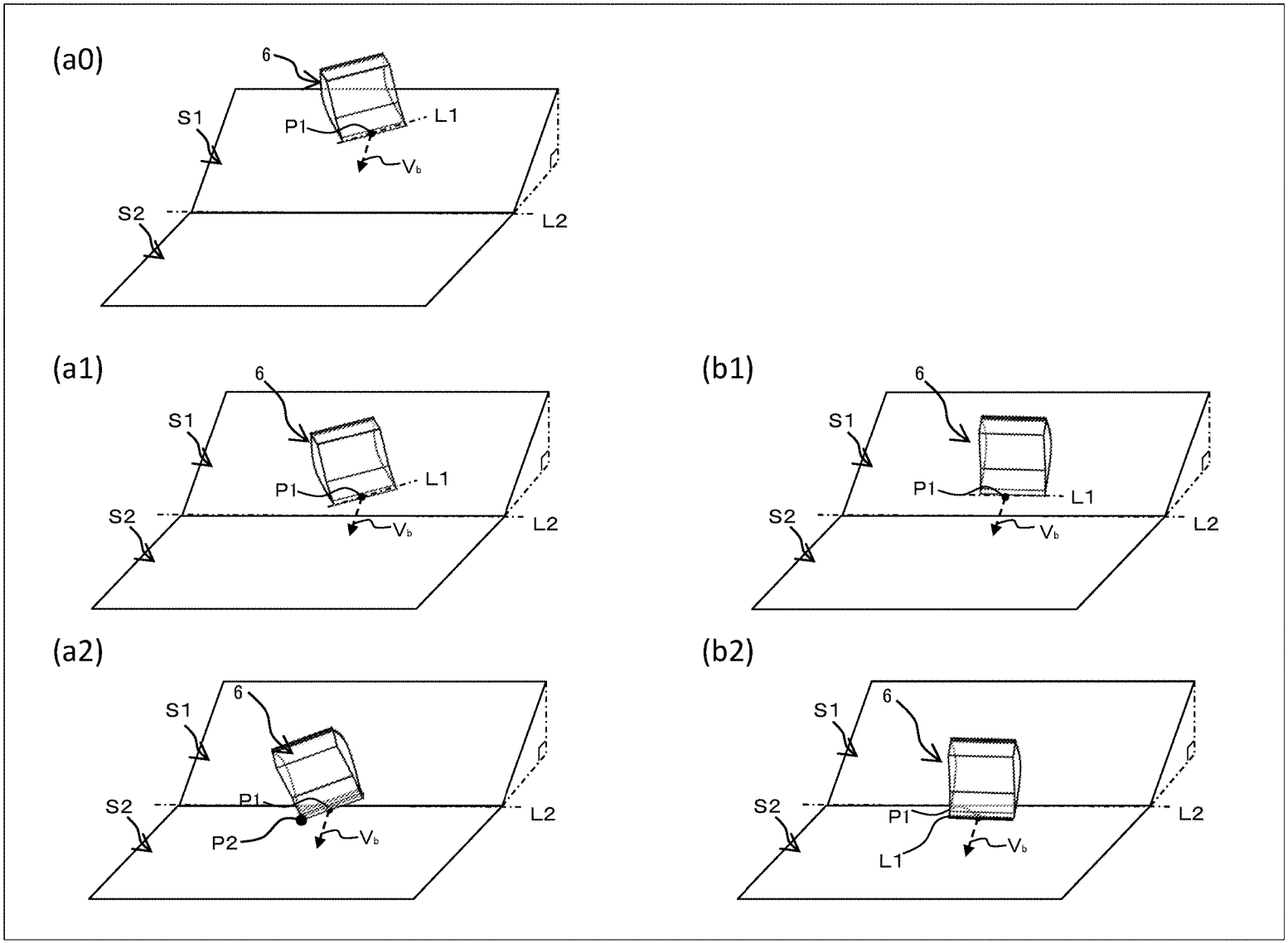
FIG. 8 is a diagram depicting the operation of the work tool through posture correction by the posture correction amount calculation section according to the first embodiment of the present invention.

FIG. 8 is a diagram depicting an operation of the work tool 6 through posture correction by the posture correction amount calculation section 10*e*.

FIG. 8(*a*0) depicts an example of the result of adjusting the posture $C_b$ of the work tool 6 by the operator such that the main target surface S1 and the reference line L1 on the work tool 6 come into a line contact state. The operator operates the operation device 9*a* from this state to start a shaping work, and the work tool 6 is moved in the direction of the predicted target surface S2 at a moving velocity $V_b$.

FIG. 8(*a*1) and FIG. 8(*a*2) depict an example of the result in a case of performing a shaping work of the main target surface S1 and the predicted target surface S2 in a state in which the rotational angle of the rotary motor 6*c* is not corrected by the posture correction amount calculation section 10*e* after starting from the state of FIG. 8(*a*0). In FIG. 8(*a*1) in which the work tool 6 is present in the upper region of the main target surface S1 and is close to the boundary line L2, the rotary corrected velocity $\omega_{y,\ mod}$ has not been issued as a command to the rotary motor 6*c* by the posture correction amount calculation section 10*e*, and, therefore, a shaping work of the main target surface S1 is being performed in a state in which the reference line L1 on the work tool 6 and the boundary line L2 are not parallel to each other. In FIG. 8(*a*2) in which the work tool 6 has passed the boundary line L2, only a point P2 on the work tool 6 makes contact with the predicted target surface S2 after the passage through the boundary line L2, and the predicted target surface S2 in the vicinity of the boundary line L2 is shaped in a point contact state. Therefore, in a state in which the shaping of the predicted target surface S2 is insufficient, the work tool 6 is moved in the direction of the moving velocity $V_b$. In order to shape the predicted target surface S2 in the vicinity of the boundary line L2, the work tool 6 should be operated so as to return to the vicinity of the boundary line S2 after correcting the posture $C_b$ of the work tool 6 so as to come into a line contact state in relation to the predicted target surface S2. This generates a waste of work, whereby efficiency of the shaping work is lowered.

FIG. 8(*b*1) and FIG. 8(*b*2) depict an example of the result in a case of performing a shaping work of the main target surface S1 and the predicted target surface S2 in a state in which the rotational angle of the rotary motor 6*c* has been corrected by the posture correction amount calculation section 10*e* after starting from the state of FIG. 8(*a*0). In FIG. 8(*b*1) in which the work tool 6 is in the upper region of the main target surface S1 and is close to the boundary line S2, a shaping work of the main target surface S1 is being performed in a state in which a rotary corrected velocity $\omega_{y,\ mod}$ has been issued as a command to the rotary motor 6*c* by the posture correction amount calculation section 10*e* and the reference line L1 on the work tool 6 and the boundary line L2 have become parallel to each other. In FIG. 8(*b*2) in which the work tool 6 has passed the boundary line L2, the reference line L1 and the predicted target surface S2 come into a line contact state after the passage through the boundary line L2, and the predicted target surface S2 in the vicinity of the boundary line L2 is shaped in a line contact state. Therefore, the shaping of the predicted target surface S2 in the vicinity of the boundary line L2 is realized in the line contact state, thus shaping accuracy in the vicinity of the boundary line L2 is enhanced.

Figure 9:
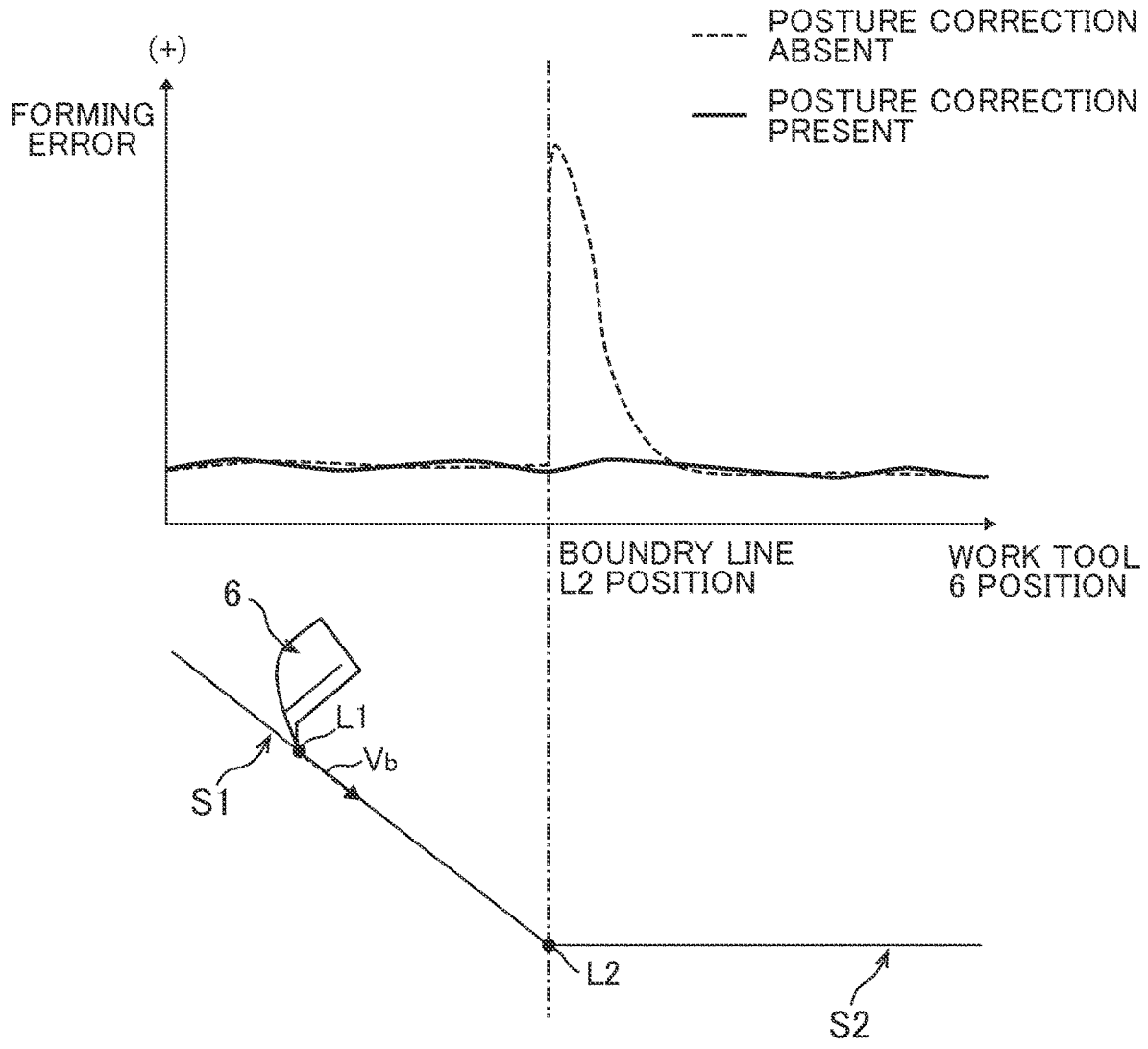
FIG. 9 is a diagram depicting the effect of enhancing shaping accuracy in the vicinity of a boundary line according to the first embodiment of the present invention.

FIG. 9 is a diagram depicting the effect of enhancing the shaping accuracy in the vicinity of the boundary line L2 by the present invention.

A shaping error generated where the rotational angle of the rotary motor 6*c* has not been corrected by the posture correction amount calculation section 10*e* is indicated by broken line, whereas a shaping error generated where the rotational angle of the rotary motor 6*c* has been corrected by the posture correction amount calculation section 10*e* is indicated by solid line. Here, the shaping error is defined as an error in the height direction of the target surfaces S1 and S2 and the terrain profile after the shaping operation. At the time of a shaping work of the main target surface S1 before passing the boundary line L2, as depicted in FIG. 8(*a*0), it is assumed that the posture $C_b$ of the work tool 6 has been manually corrected by the operator before starting the shaping work such that the work tool 6 comes into a line contact state with the main target surface S1. In this case, there is no difference in the shaping error in regard of the main target surface S1 between the case (broken line) where posture correction is absent and the case (solid line) where posture correction is present.

In the case (broken line) where the posture correction is absent, as depicted in FIG. 8(*a*2), the instant when the work tool 6 passes the boundary line L2, since the work tool 6 and the predicted target surface S2 come into a point contact state, the shaping error increases. Thereafter, the operator operates such that the work tool 6 comes into a line contact state in relation to the predicted target surface S2, whereby the shaping error is gradually decreased. On the other hand, in the case (solid line) where the posture correction is present, as depicted in FIG. 8(*b*2), since the work tool 6 and the predicted target surface S2 are in the line contact state even immediately after the passage through the boundary line L2, the shaping work of the predicted target surface S2 can be continued, without an increase in the shaping error even after the passage through the boundary line L2.

In the present embodiment, the work machine 100 includes: the work tool 6; a plurality of actuators 2*a*, 3*a*, 4*a*, 5*a*, 6*a*, 6*b*, and 6*c* including at least one position control actuator 2*a*, 4*a*, 5*a* that controls the position of the work tool 6 and at least one posture control actuator 6*c* that controls the posture of the work tool 6; the operation device 9*a* that instructs the plurality of actuators on operations of the actuators; the controller 10 that outputs a control signal for controlling at least one of the plurality of actuators 2*a*, 3*a*, 4*a*, 5*a*, 6*a*, 6*b*, and 6*c* on the basis of the operation amount of the operation device 9*a*; and the design surface storage device 21 that stores information concerning the design surface including a plurality of target surfaces, the controller 10 extracting the first target surface S1 which is a target surface nearest to the work tool 6 from among the plurality of target surfaces and, on the basis of the position and posture of the work tool 6 relative to the first target surface S1, controlling the operation velocity of at least one actuator of the plurality of actuators, in which the controller 10 extracts the second target surface S2 which is a target surface adjacent to the first target surface S1 from among the plurality of target surfaces, calculates the first boundary line L2 which is a boundary line between the first target surface S1 and the second target surface S2, and, prior to the work tool 6 passing the first boundary line L2, corrects a control signal of the posture control actuator 6*c* such that the angular difference $E_L$ between the reference line L1 set on the work tool 6 and the first boundary line L2 becomes small.

According to the hydraulic excavator 100 according to the present embodiment configured as above, the angular difference $E_L$ between the reference line L2 set on the work tool 6 and the boundary line L2 between the adjacent two target surfaces S1 and S2 is calculated, and, prior to the work tool 6 passing the boundary line L2, the posture of the work tool 6 is controlled such that the angular difference $E_L$ between the reference line L1 and the boundary line L2 becomes small. As a result, at the time when the work tool 6 passes the boundary line L2, the line contact state between the work tool 6 and each of the target surfaces S1 and S2 is maintained, thus shaping accuracy in the vicinity of the boundary line L2 can be enhanced.

Embodiment 2

Figure 10:
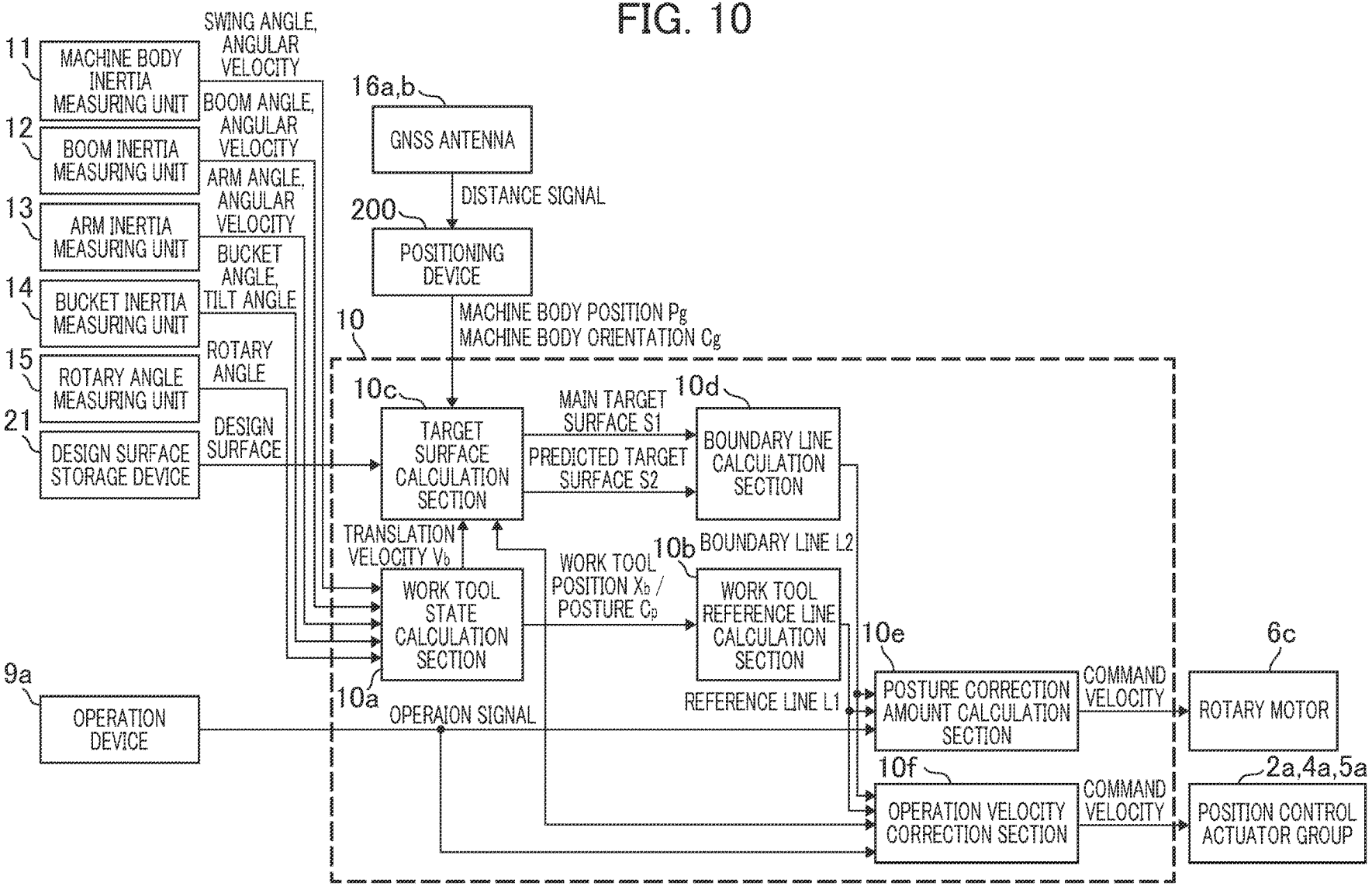
FIG. 10 is a functional block diagram depicting the details of processing functions of a controller according to a second embodiment.

FIG. 10 is a functional block diagram depicting the details of a processing function of a controller 10 according to a second embodiment.

The controller 10 has an operation velocity correction section 10*f* that corrects the moving velocity $V_b$ of the work tool 6, on the basis of the position $X_b$ of the work tool 6 calculated by a work tool state calculation section 10*a*, a reference line L1 calculated by a work tool reference line calculation section 10*b*, a boundary line L2 calculated by a boundary line calculation section 10*d*, and an operation signal acquired from an operation device 9*a*. A command velocity calculated by the operation velocity correction section 10*f* is outputted to a swing motor 2*a*, a boom cylinder 4*a* and an arm cylinder 5*a* which are actuators capable of controlling the position $X_b$ of the work tool 6.

Figure 11:
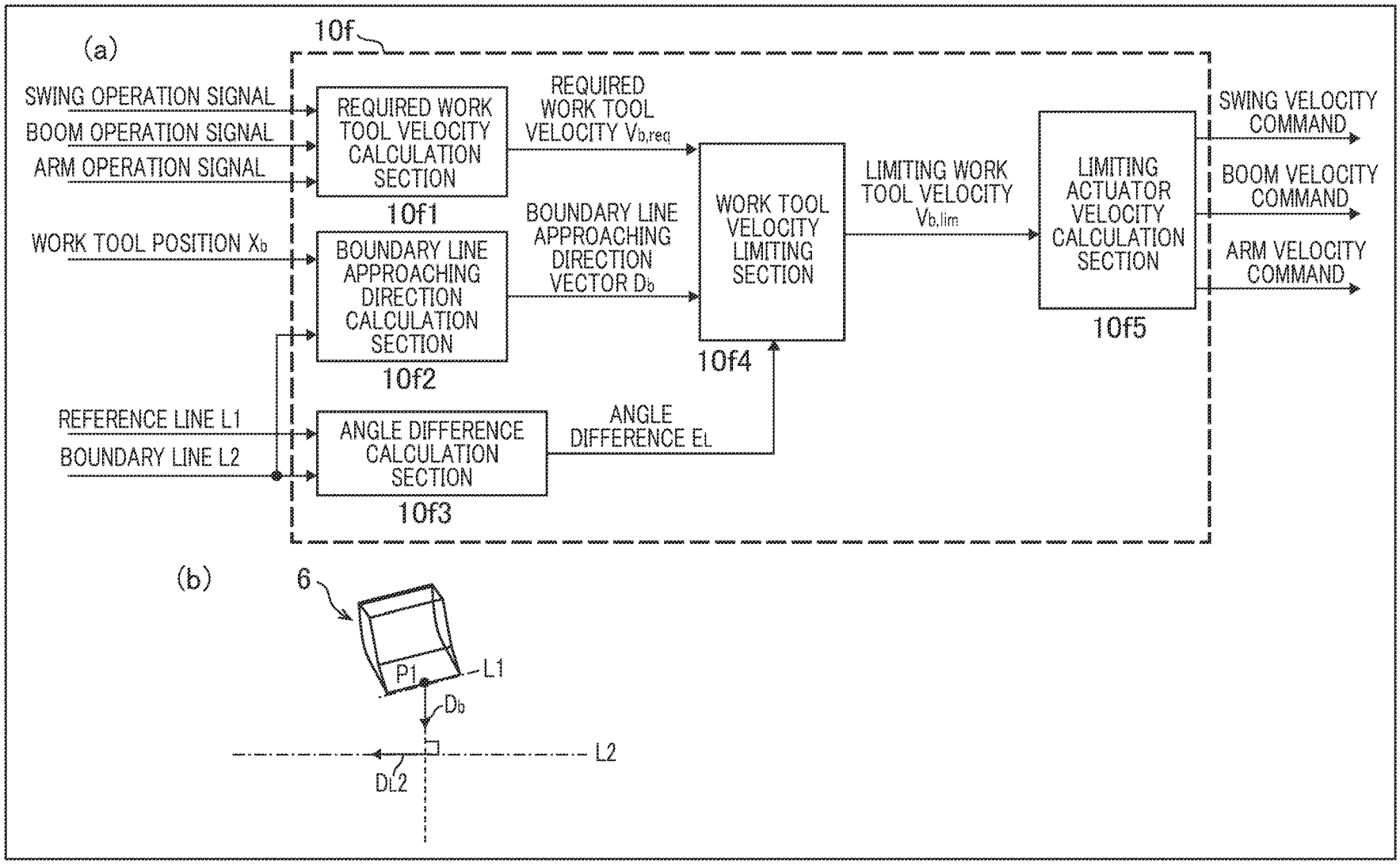
FIG. 11 is a functional block diagram depicting the details of processing functions of an operating velocity correction section according to the second embodiment.

FIG. 11 is a functional block diagram depicting the details of a processing function of the operation velocity correction section 10*f* according to the second embodiment.

The functional block diagram of the operation velocity correction section 10*f* depicted in FIG. 11(*a*) includes a required work tool velocity calculation section 10*f*1, a boundary line approaching direction calculation section 10*f*2, an angular difference calculation section 10*f*3, a work tool velocity limiting section 10*f*4, and a limited actuator velocity calculation section 10*f*5.

The required work tool velocity calculation section 10*f*1 calculates a required velocity $V_{b,\ req}$ of a reference point P1 set on the work tool 6, from a swing operation signal, a boom operation signal and an arm operation signal acquired from the operation device 9*a*.

The boundary line approaching direction calculation section 10*f*2 calculates a direction vector (hereinafter referred to as boundary line approaching direction vector) $D_b$ directed from the reference point P1 on the work tool 6 toward the boundary line L2, from the position $X_b$ of the work tool 6 calculated by the work tool state calculation section 10*a* and a direction vector $D_L$2 of the boundary line L2 calculated by the boundary line calculation section 10*d*. As depicted in FIG. 11(*b*), the boundary line approaching direction vector $D_b$ is the direction of a perpendicular drawn from the reference point P1 on the work tool 6 to the boundary line L2, and is given as a three-dimensional direction vector for which Euclidean norm is 1.

The angular difference calculation section 10*f*3 calculates an angular difference $E_L$ from the formula (2), on the basis of a direction vector $D_L$1 of the reference line L1 calculated by the work tool reference line calculation section 10*b* and a direction vector $D_L$2 of the boundary line L2 calculated by the boundary line calculation section 10*d*.

The work tool velocity limiting section 10*f*4 calculates a limited work tool velocity $V_{b,\ lim}$ on the basis of the angular difference $E_L$ between the reference line L1 and the boundary line L2, and limits a required work tool velocity $V_{b,\ req}$ in the direction of the boundary line approaching direction vector $D_b$ to equal to or lower than the limited work tool velocity $V_{b,\ lim}$. As an example, the limited work tool velocity $V_{b,\ lim,\ x}$ in the x direction is calculated in the manner of the following formula (4).

[Math 4]

$$V_{b,lim,x} = \begin{cases} \min(V_{b,max,x} - k_2|E_L|D_{b,x},\ V_{b,req,x}) & (V_{b,req,x} \geq 0,\ D_{b,x} \geq 0) \\ V_{b,req,x} & (V_{b,req,x} \geq 0,\ D_{b,x} < 0) \\ V_{b,req,x} & (V_{b,req,x} < 0,\ D_{b,x} \geq 0) \\ \max(-V_{b,max,x} + k_2|E_L|D_{b,x},\ V_{b,req,x}) & (V_{b,req,x} < 0,\ D_{b,x} < 0) \end{cases} \quad (4)$$

Here, $V_{b,\ max,\ x}$ is a maximum velocity at which the work tool 6 can translate in the x direction, and $k_2$ is a gain representing the deceleration degree of the moving velocity $V_b$ of the work tool 6 relative to the angular difference $E_L$. The limiting system of the formula (4) ensures that, when the work tool 6 approaches the boundary line L2, a velocity limiting according to the angular difference $E_L$ is performed, whereas when the work tool 6 is spaced away from the boundary line L2, the required work tool velocity $V_{b,\ req}$ is outputted without correction. Limiting in the y direction and z direction is similar to this, and, therefore, description thereof is omitted.

The limited actuator velocity calculation section 10*f*5 decomposes the limited work tool velocity $V_{b,\ lim}$ outputted by the work tool velocity limiting section 10*f*4 into respective velocity commands for the swing motor 2*a*, the boom cylinder 4*a* and the arm cylinder 5*a*, and calculates a swing velocity command, a boom velocity command and an arm velocity command.

In the present embodiment, when correcting the control signal for the posture control actuator 6*c*, the controller 10 corrects the control signals for the position control actuators 2*a*, 4*a*, and 5*a* such that the deceleration degree of the moving velocity $V_b$ of the work tool 6 on the direction toward the first boundary line L2 becomes larger as the angular difference $E_L$ between the reference line L1 and the first boundary line L2 is larger.

In the hydraulic excavator 100 according to the present embodiment configured as above, also, an effect similar to that in the first embodiment is obtained.

In addition, when the work tool 6 is operated to the direction of spacing away from the boundary line L2, correction of the posture $\theta_y$ in the yawing direction of the work tool 6 and deceleration of the moving velocity $V_b$ are not performed, thus work efficiency in the vicinity of the boundary line L2 can be enhanced.

Since the deceleration degree of the moving velocity $V_b$ of the work tool 6 on the direction toward the first boundary line L2 is larger as the angular difference $E_L$ between the reference line L1 and the first boundary line L2 is larger, the work tool 6 can be prevented from passing the boundary line L2 before the correction of the posture $C_b$ of the work tool by the posture correction amount calculation section 10*e* is finished. As a result, the line contact state of the work tool 6 relative to the predicted target surface S2 after passage through the boundary line L2 can be securely maintained, thus shaping accuracy in the vicinity of the boundary line L2 is ensured.

Embodiment 3

Figure 12:
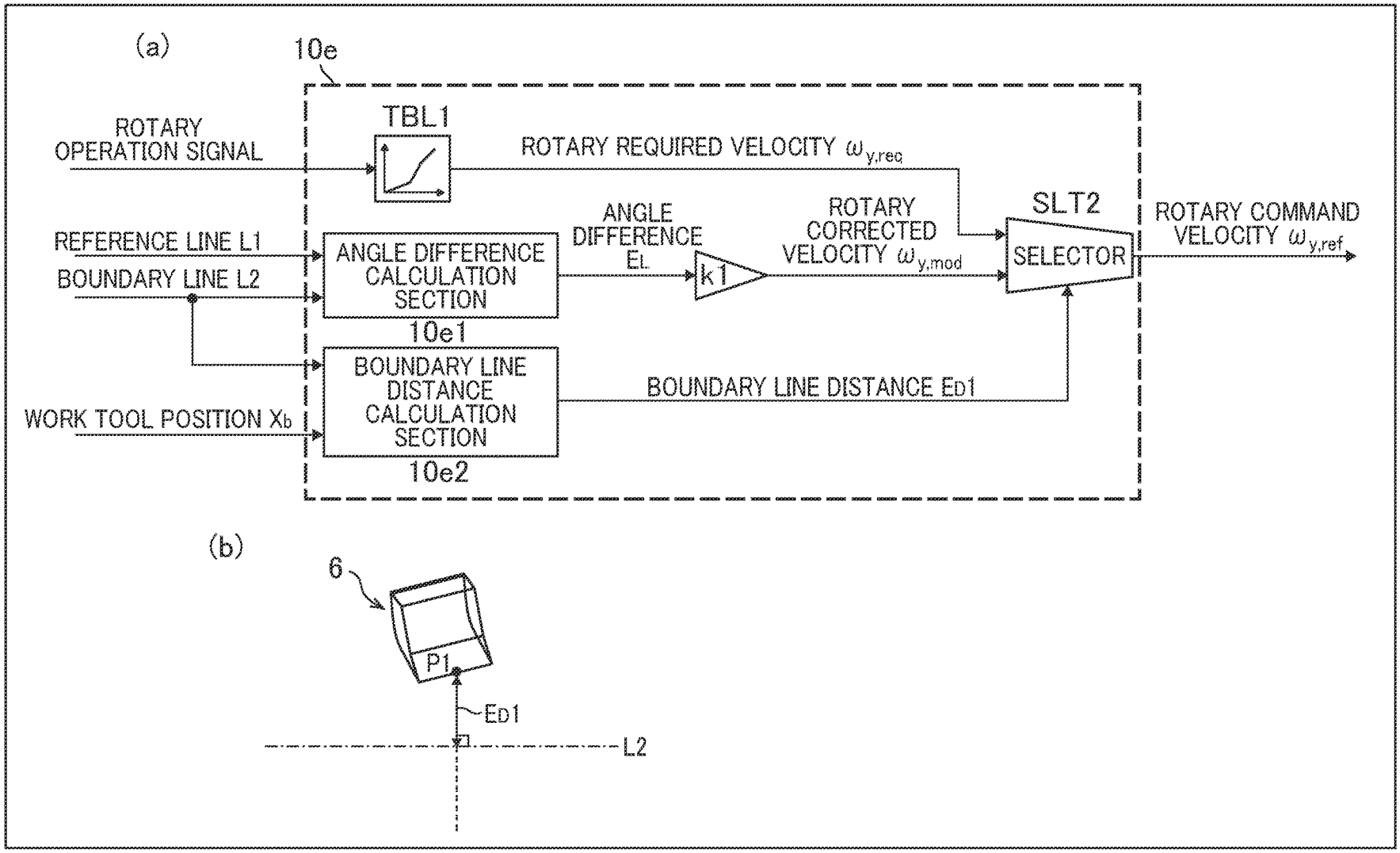
FIG. 12 is a functional block diagram depicting the details of processing functions of a posture correction amount calculation section according to a third embodiment.

FIG. 12 is a functional block diagram depicting the details of a processing function of a posture correction amount calculation section 10*e* according to a third embodiment.

The functional block diagram of the posture correction amount calculation section 10*e* depicted in FIG. 12(*a*) includes an angular difference calculation section 10*e*1 and a boundary line distance calculation section 10*e*2.

The boundary line distance calculation section 10*e*2 calculates the distance $E_D$1 between the boundary line L2 and a reference point P1 on the work tool 6. As depicted in FIG. 12(*b*), the distance $E_D$1 is defined as the length of a perpendicular drawn from the reference point P1 on the work tool 6 to the boundary line L2. The distance $E_D$1 calculated by the boundary line distance calculation section 10*e*2 is outputted to a selector SLT2. The selector SLT2 selects either a rotary required velocity $\omega_{y,\ req}$ or a rotary corrected velocity $\omega_{y,\ mod}$ by the following system, and outputs it as a rotary command velocity $\omega_{y,\ ref}$.

[Math 5]

$$\omega_{y,ref} = \begin{cases} \omega_{y,req} & (E_D1 \geq T_{D1}) \\ \omega_{y,\mathrm{mod}} & (E_D1 < T_{D1}) \end{cases} \tag{5}$$

Here, $T_{D1}$ is a threshold of a distance for determining whether or not the rotational angle of the rotary motor 6*c* is to be corrected. When the distance $E_D$1 is equal to or more than the threshold $T_{D1}$ by the formula (5), the required work tool velocity $\omega_{y,\ req}$ calculated by the operation signal is outputted, and correction of the posture $\theta_y$ in the yawing direction of the work tool 6 by the posture correction amount calculation section 10*e* is not performed.

Figure 13:
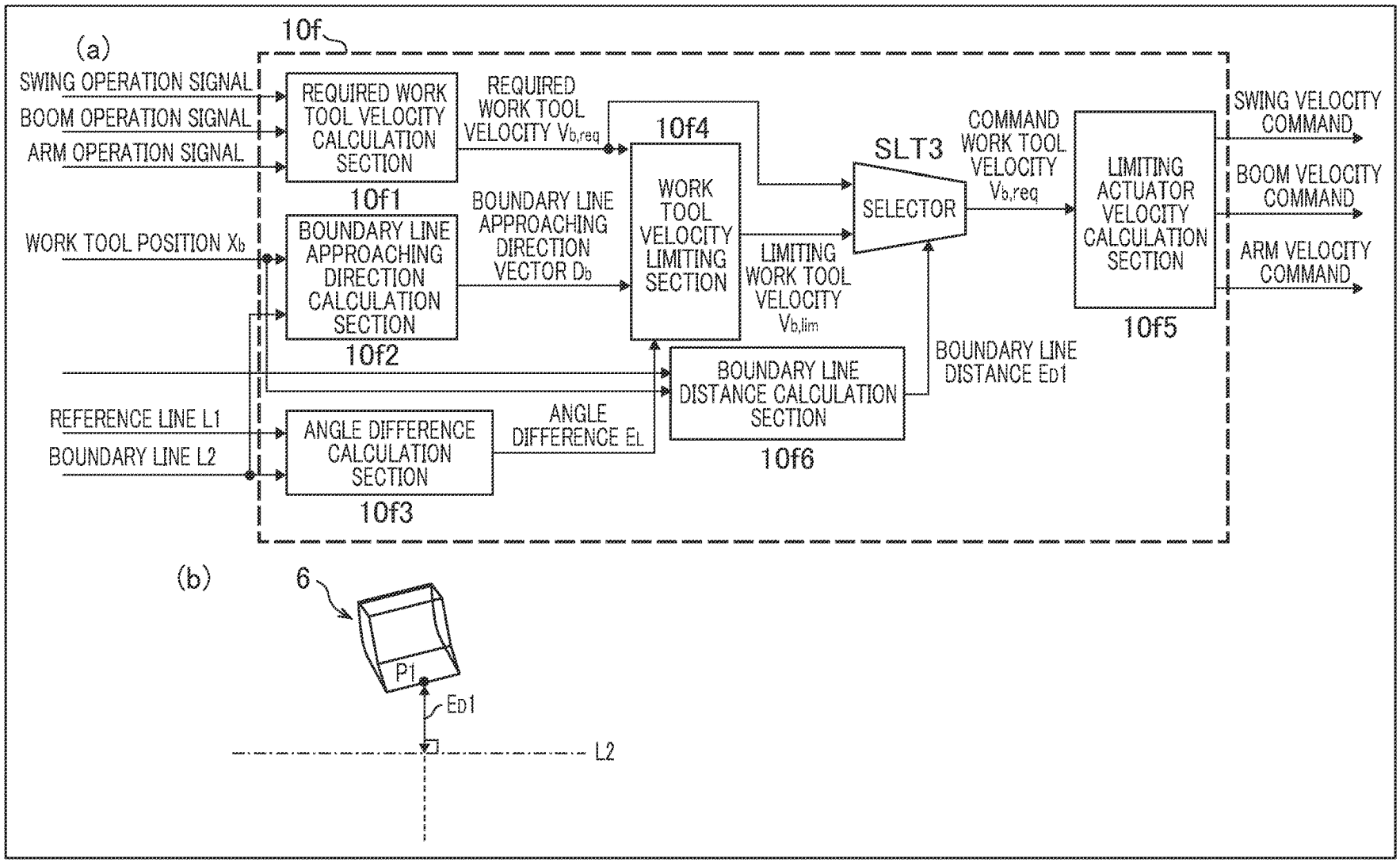
FIG. 13 is a functional block diagram depicting the details of processing functions of an operating velocity correction section according to the third embodiment.

FIG. 13 is a functional block diagram depicting the details of a processing function of the operation velocity correction section 10*f* according to the present embodiment.

The functional block diagram of the operation velocity correction section 10*f* depicted in FIG. 13(*a*) includes a required work tool velocity calculation section 10*f*1, a boundary line approaching direction calculation section 10*f*2, an angular difference calculation section 10*f*3, a work tool velocity limiting section 10*f*4, a limited actuator velocity calculation section 10*f*5, and a boundary line distance calculation section 10*f*6.

The boundary line distance calculation section 10*f*6, like the boundary line distance calculation section 10*e*2, calculates the distance $E_D$1 between the boundary line L2 and the reference point P1 on the work tool 6. As depicted in FIG. 13(*b*), the distance $E_D$1 is defined as the length of a perpendicular from the reference point P1 on the work tool 6 to the boundary line L2. The distance $E_D$1 calculated by the boundary line distance calculation section 10*f*6 is outputted to a selector SLT3. The selector SLT3 selects either the required work tool velocity $V_{b,\ req}$ or the limited work tool velocity $V_{b,\ lim}$ by the following system, and outputs it as a work tool command velocity $V_{b,\ ref}$.

[Math 6]

$$V_{b,ref} = \begin{cases} V_{b,req} & (E_D1 \geq T_{D2}) \\ V_{b,lim} & (E_D1 < T_{D2}) \end{cases} \tag{6}$$

Here, $T_{D2}$ is a threshold of a distance for determining whether or not limiting of the moving velocity $V_b$ is to be performed. When the distance ED1 is equal to or more than the threshold $T_{D2}$ by the formula (6), the required work tool velocity $V_{b,\ req}$ calculated by the operation signal is outputted, and deceleration of the moving velocity $V_b$ by the operation velocity correction section 10*f* is not performed.

In the present embodiment, the controller 10 calculates the first boundary line distance $E_D$1 which is the distance from the reference point P1 set on the work tool 6 to the first boundary line L2, and, when the first boundary line distance $E_D$1 is less than the threshold $T_{D1}$, the controller 10 corrects the control signal for the posture control actuator 6*c* such that the angle $E_L$ between the reference line L1 and the first boundary line L2 becomes small.

In addition, when the first boundary line distance $E_D$1 is less than the threshold $T_{D2}$, the controller 10 corrects the control signals for the position control actuators 2*a*, 4*a*, and 5*a* such that the moving velocity $V_b$ of the work tool 6 becomes equal to or less than the limited velocity $V_{b,\ lim}$.

In the present embodiment configured as above, also, an effect similar to that in the first embodiment is obtained.

In addition, when the distance $E_D$1 from the reference point P1 on the work tool 6 to the boundary line L2 is equal to or more than the threshold $T_{D1}$, correction of the posture $\theta_y$ in the yawing direction of the work tool 6 is not performed, and, when the distance $E_D$1 is equal to or more than the threshold $T_{D2}$, deceleration of the moving velocity $V_b$ is not performed, thus work efficiency in a region largely spaced away from the boundary line L2 can be enhanced.

Embodiment 4

Figure 14:
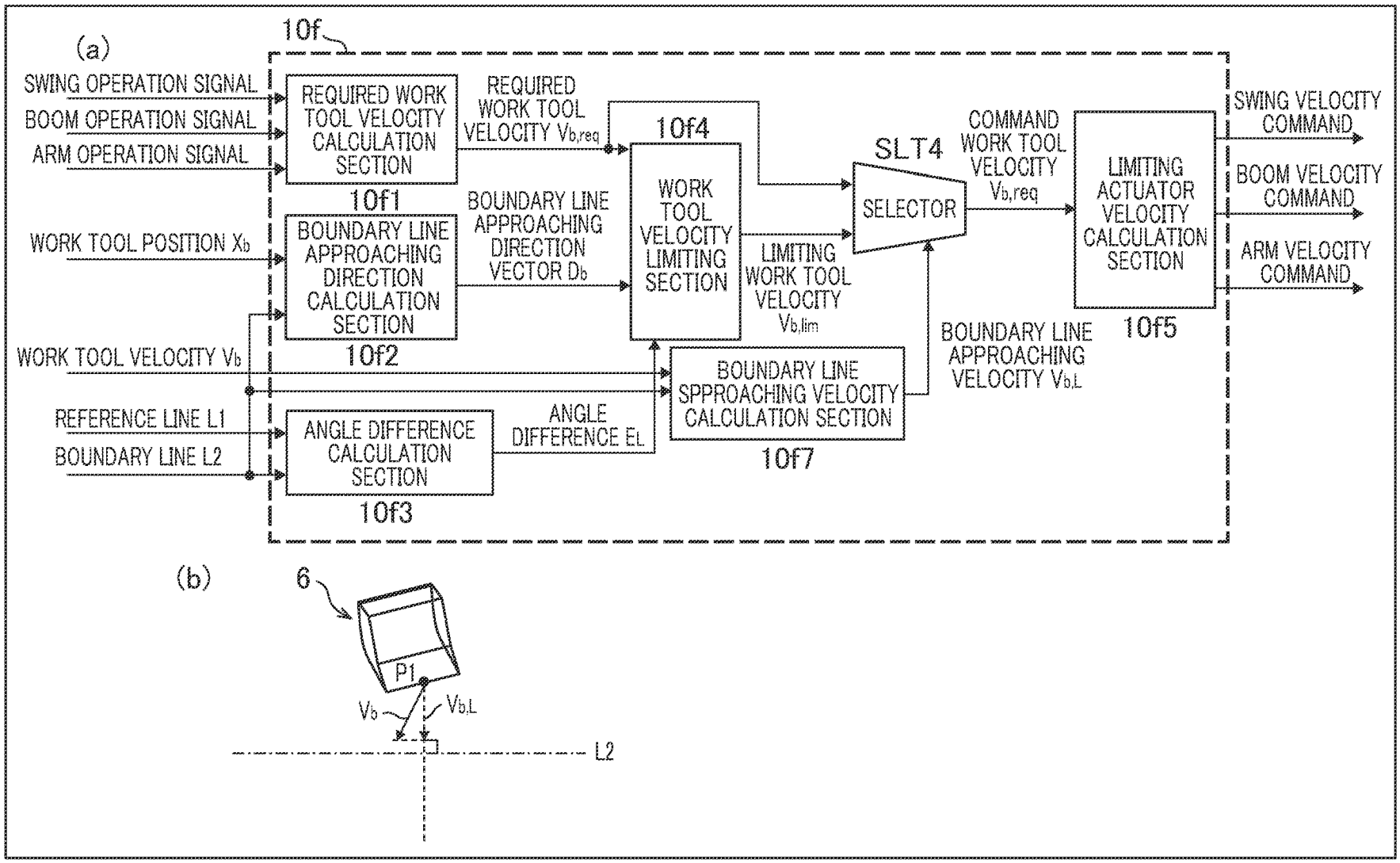
FIG. 14 is a functional block diagram depicting the details of processing functions of an operating velocity correction section according to a fourth embodiment.

FIG. 14 is a functional block diagram depicting the details of a processing function of an operation velocity correction section 10*f* according to a fourth embodiment.

The functional block diagram of the operation velocity correction section 10*f* depicted in FIG. 14(*a*) includes a required work tool velocity calculation section 10*f*1, a boundary line approaching direction calculation section 10*f*2, an angular difference calculation section 10*f*3, a work tool velocity limiting section 10*f*4, a limited actuator velocity calculation section 10*f*5, and a boundary line approaching velocity calculation section 10*f*7.

The boundary line approaching velocity calculation section 10*f*7 calculates a velocity component (hereinafter, referred to as boundary line approaching velocity) $V_{b,\ L}$ in the direction directed from the reference point P1 on the work tool 6 toward the boundary line L2. As depicted in FIG. 14(*b*), the boundary line approaching velocity $V_{b,\ L}$ is defined as a component in the direction of a perpendicular drawn from the reference point P1 on the work tool 6 to the boundary line L2 in relation to the moving velocity $V_b$. The boundary line approaching velocity $V_{b,\ L}$ calculated by the boundary line approaching velocity calculation section 10*f*7 is outputted to a selector SLT4. The selector SLT4 selects either a required work tool velocity $V_{b,\ req}$ or a limited work tool velocity $V_{b,\ lim}$ by the following system, and outputs it as a work tool command velocity $V_{b,\ ref}$.

[Math 7]

$$V_{b,ref} = \begin{cases} V_{b,req} & (V_{b,L} < T_V) \\ V_{b,lim} & (V_{b,L} \geq T_V) \end{cases} \tag{7}$$

Here, $T_V$ is a threshold of a velocity for determining whether or not limiting of the moving velocity $V_b$ is to be performed. When the velocity $V_{b,\ L}$ in the direction toward the boundary line L2 is less than the threshold $T_V$ by the formula (7), a required work tool velocity $V_{b,\ req}$ calculated by an operation signal is outputted, and deceleration of the moving velocity $V_b$ by the operation velocity correction section 10*f* is not performed.

In the present embodiment, the controller 10 calculates the boundary line approaching velocity $V_{b,\ L}$ which is a velocity component in the direction toward the first boundary line L2 of the moving velocity $V_b$ of the work tool 6, and, when the boundary line approaching velocity $V_{b,L}$ is equal to or more than the threshold $T_V$, the controller 10 corrects the control signals for the position control actuators 2*a*, 4*a*, and 5*a* such that the moving velocity $V_b$ of the work tool 6 becomes equal to or less than a limited velocity $V_{b,lim}$.

In the present embodiment configured as above, also, an effect similar to that in the first embodiment is obtained.

In addition, when the velocity $V_{b,L}$ in the direction toward the boundary line L2 of the work tool 6 is equal to or more than the threshold $T_V$, the work tool command velocity $V_{b,ref}$ is limited to the limited work tool velocity $V_{b,lim}$, thus the work tool 6 can be prevented from passing the boundary line L2 before correction of the posture Cb of the work tool 6 by the posture correction amount calculation section 10*e* is finished. As a result, the line contact state of the work tool 6 relative to the predicted target surface S2 after the passage through the boundary line L2 can be securely maintained, and shaping accuracy in the vicinity of the boundary line L2 is ensured.

Embodiment 5

Figure 15:
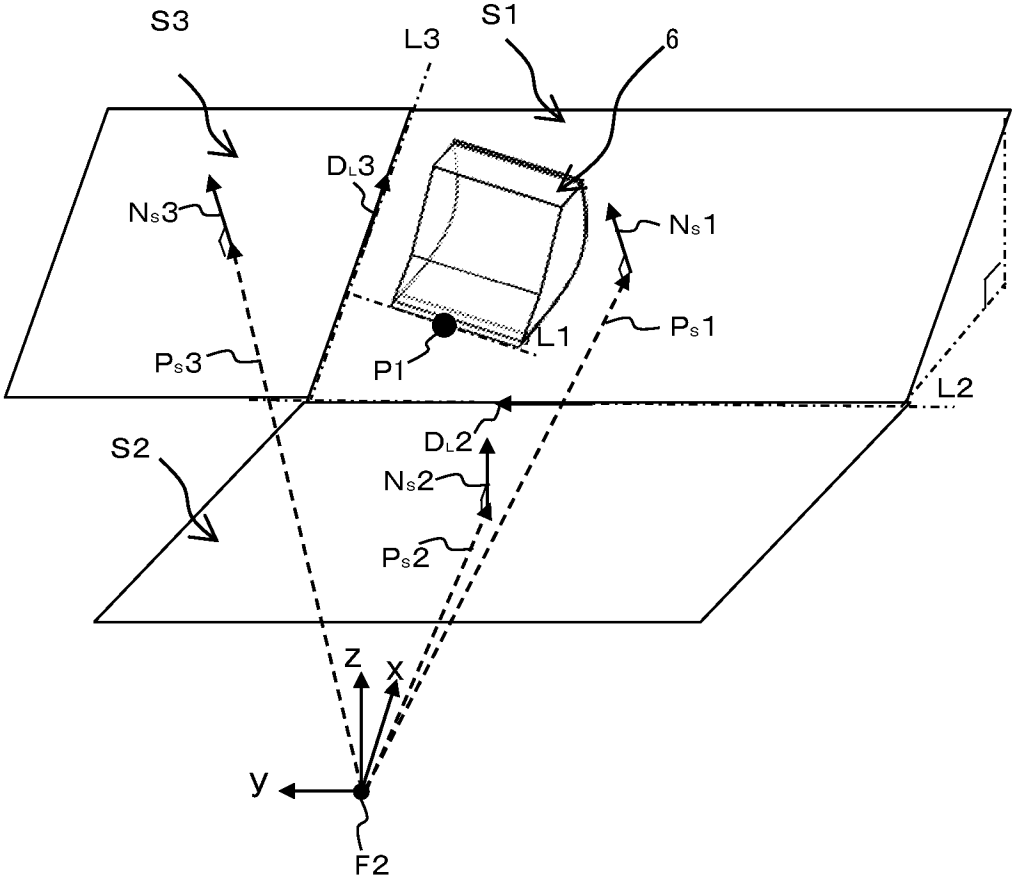
FIG. 15 is a diagram depicting the details of the definition of a target surface according to a fifth embodiment.

FIG. 15 is a diagram depicting the details of definitions of the target surfaces S1, S2, and S3 according to a fifth embodiment.

Calculations concerning posture control for the work tool 6 is performed on the basis of a second predicted target surface S3, in addition to the main target surface S1 and the predicted target surface S2. The second predicted target surface S3 is defined as a target surface S for which the distance of a perpendicular drawn from the reference point P1 to the boundary line with the main target surface S1 is smaller following to the predicted target surface S2. Like the target surfaces S1 and S2, the second predicted target surface S3 is expressed by a reference position $P_S3=(P_S3_x, P_S3_y, P_S3_z)$ with the lower track structure coordinate system F2 as a reference and a three-dimensional normal vector $N_S3=(N_S3_x, N_S3_y, N_S3_z)$ for which Euclidean norm with the lower track structure coordinate system F2 as a reference is 1.

In addition, a boundary line between the main target surface S1 and the second predicted target surface S3 is defined as a boundary line L3. The boundary line L3 is expressed by a three-dimensional direction vector $D_L3=(D_L3_x, D_L3_y, D_L3_z)$ for which Euclidean norm with the lower track structure coordinate system F2 as a reference is 1. The calculating method for the boundary line L3 is similar to the calculation of the boundary line L2 by the formula (1), and, therefore, description thereof is omitted.

Figure 16:
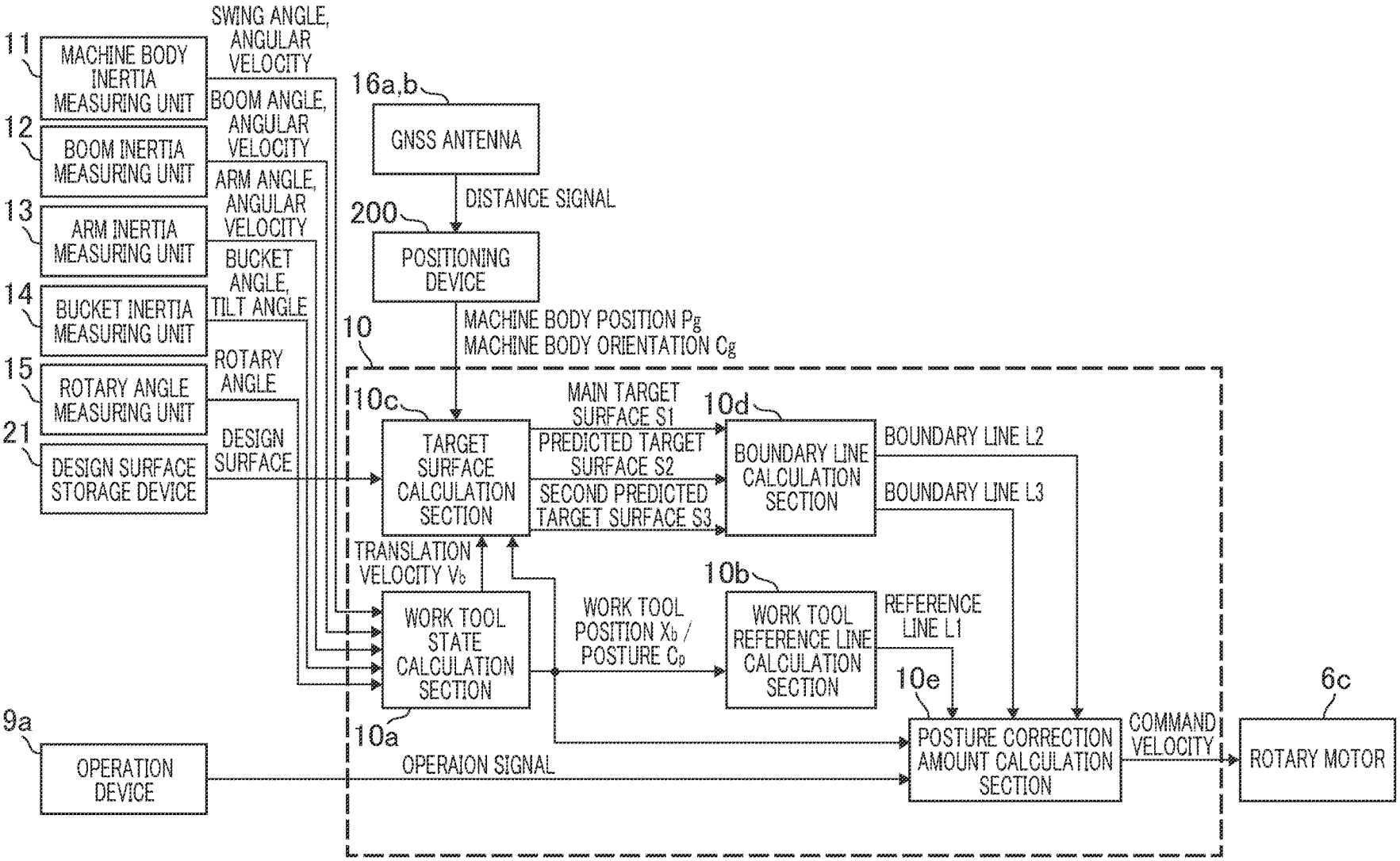
FIG. 16 is a functional block diagram depicting the details of processing functions of a controller according to the fifth embodiment.

FIG. 16 is a functional block diagram depicting the details of a processing function of a controller 10 according to the present embodiment.

A target surface calculation section 10*c* extracts the second predicted target surface S3, in addition to the main target surface S1 and the predicted target surface S2. The calculated values concerning the target surfaces S1, S2, and S3 calculated are outputted to a boundary line calculation section 10*d*.

The boundary line calculation section 10*d* calculates a boundary line L3 between the main target surface S1 and the second predicted target surface S3, in addition to the boundary line L2 between the main target surface S1 and the predicted target surface S2.

A posture correction amount calculation section 10*e* calculates a command velocity $\omega_{y,ref}$ for a rotary motor 6*c*, on the basis of a work tool position $X_b$ acquired from a work tool state calculation section 10*a*, a reference line L1 acquired from a work tool reference line calculation section 10*b*, and boundary lines L2 and L3 acquired from the boundary line calculation section 10*d*.

Figure 17:
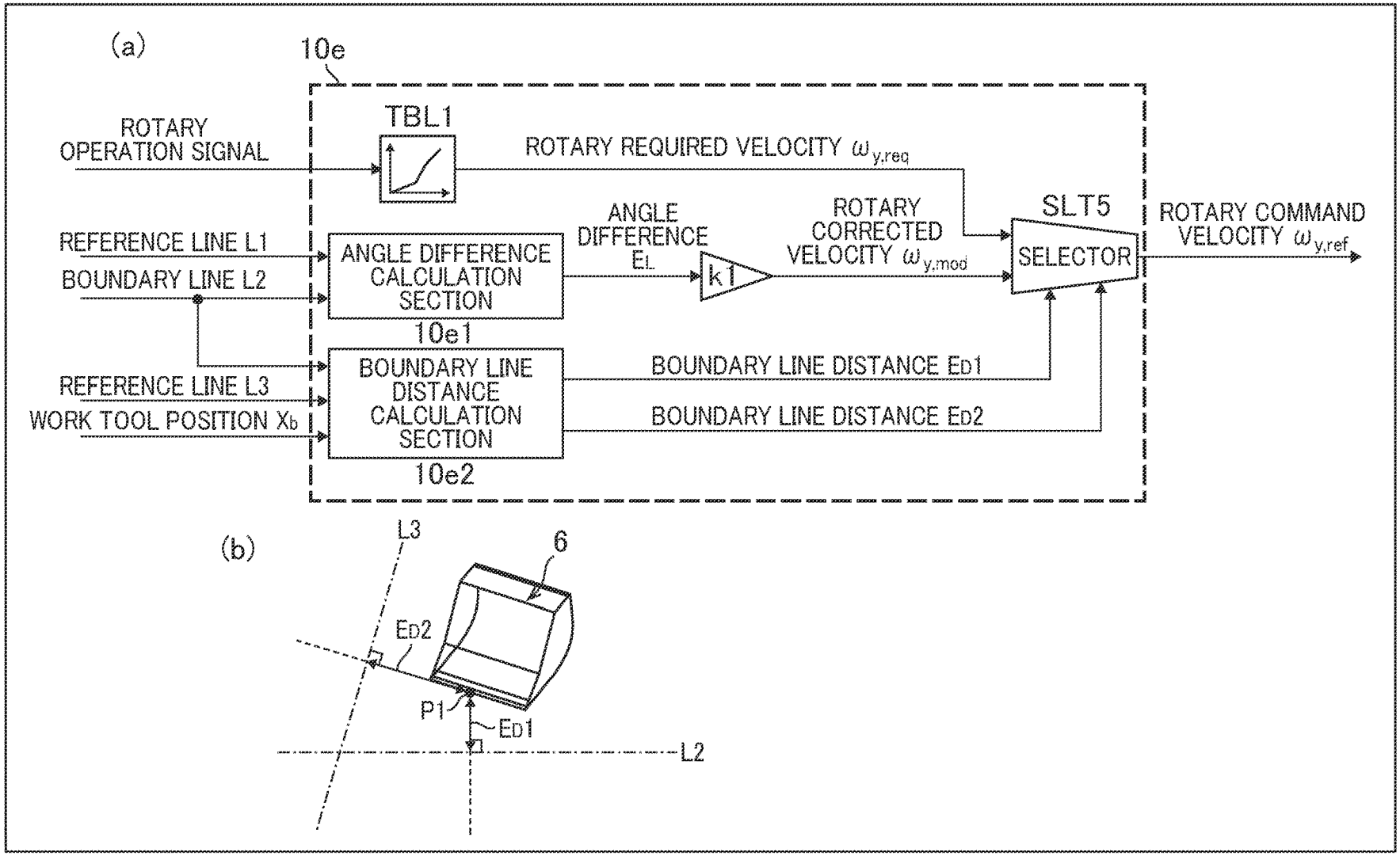
FIG. 17 is a functional block diagram depicting the details of processing functions of a posture correction amount calculation section according to the fifth embodiment.

FIG. 17 is a functional block diagram depicting the details of a processing function of a posture correction amount calculation section 10*e* according to the present embodiment.

The functional block diagram of the posture correction amount calculation section 10*e* depicted in FIG. 17(*a*) includes an angular difference calculation section 10*e*1 and a boundary line distance calculation section 10*e*2.

The boundary line distance calculation section 10*e*2 calculates a boundary line distance $E_D1$ and a boundary line distance ED2, on the basis of the boundary lines L2 and L3 and the work tool position $X_b$. As depicted in FIG. 17(*b*), the distance $E_D1$ is defined as the length of a perpendicular drawn from the reference point P1 on the work tool 6 to the boundary line L2. Similarly, the distance ED2 is defined as the length of a perpendicular drawn from the reference point P1 on the work tool 6 to the boundary line L3.

The distance $E_D1$ and the distance ED2 calculated by the boundary line distance calculation section 10*e*2 are outputted to a selector SLT5. The selector SLT5 selects either a rotary required velocity $\omega_{y,req}$ or a rotary corrected velocity $\omega_{y,mod}$ by the following system, and outputs it as a rotary command velocity $\omega_{y,ref}$.

[Math 8]

$$\omega_{y,ref} = \begin{cases} \omega_{y,req} & (E_D1 < T_{D3} \text{ and } E_D2 < T_{D3}) \\ \omega_{y,\mathrm{mod}} & (E_D1 \geq T_{D3} \text{ or } E_D2 \geq T_{D3}) \end{cases} \tag{8}$$

Here, $T_{D3}$ is a threshold of a distance for determining whether or not limiting of the moving velocity is to be performed. When both the distance $E_D1$ and the distance ED2 are less than the threshold $T_{D3}$, the rotary required velocity $\omega_{y,req}$ calculated by an operation signal is outputted, and correction of the posture $C_b$ of the work tool 6 by the posture correction amount calculation section 10*e* is not performed.

In the present embodiment, the controller 10 extracts a third target surface S3 which is a target surface adjacent to the first target surface S1, separately from the second target surface S2, from among the plurality of target surfaces, calculates a second boundary line L3 which is a boundary line between the first target surface S1 and the third target surface S3, calculates a first boundary line distance $E_D1$ which is the distance from the reference point P1 set on the work tool 6 to the first boundary line L2, calculates a second boundary line distance $E_D2$ which is the distance from the reference point P1 to the second boundary line L3, and, when both the first boundary distance $E_D1$ and the second boundary line distance $E_D2$ are less than the threshold $T_{D3}$, stops correction of the control signal for the posture control actuator 6*c*.

In the hydraulic excavator 100 according to the present embodiment configured as above, also, an effect similar to that in the first embodiment is obtained.

In addition, when the work tool 6 is close to both the boundary line L2 and the boundary line L3, correction of the posture $C_b$ of the work tool 6 is not performed; therefore, when the shaping work for the main target surface S1 is performed in the vicinity of the two target surfaces S2 and S3 adjacent to the main target surface S1, the boundary line L2 and the boundary line L3 which serve as a reference for correction of the posture $C_b$ are prevented from being changed over in a vibrating manner. As a result, the efficiency of the shaping work for the main target surface S1 can be prevented from being lowered.

Embodiment 6

Figure 18:
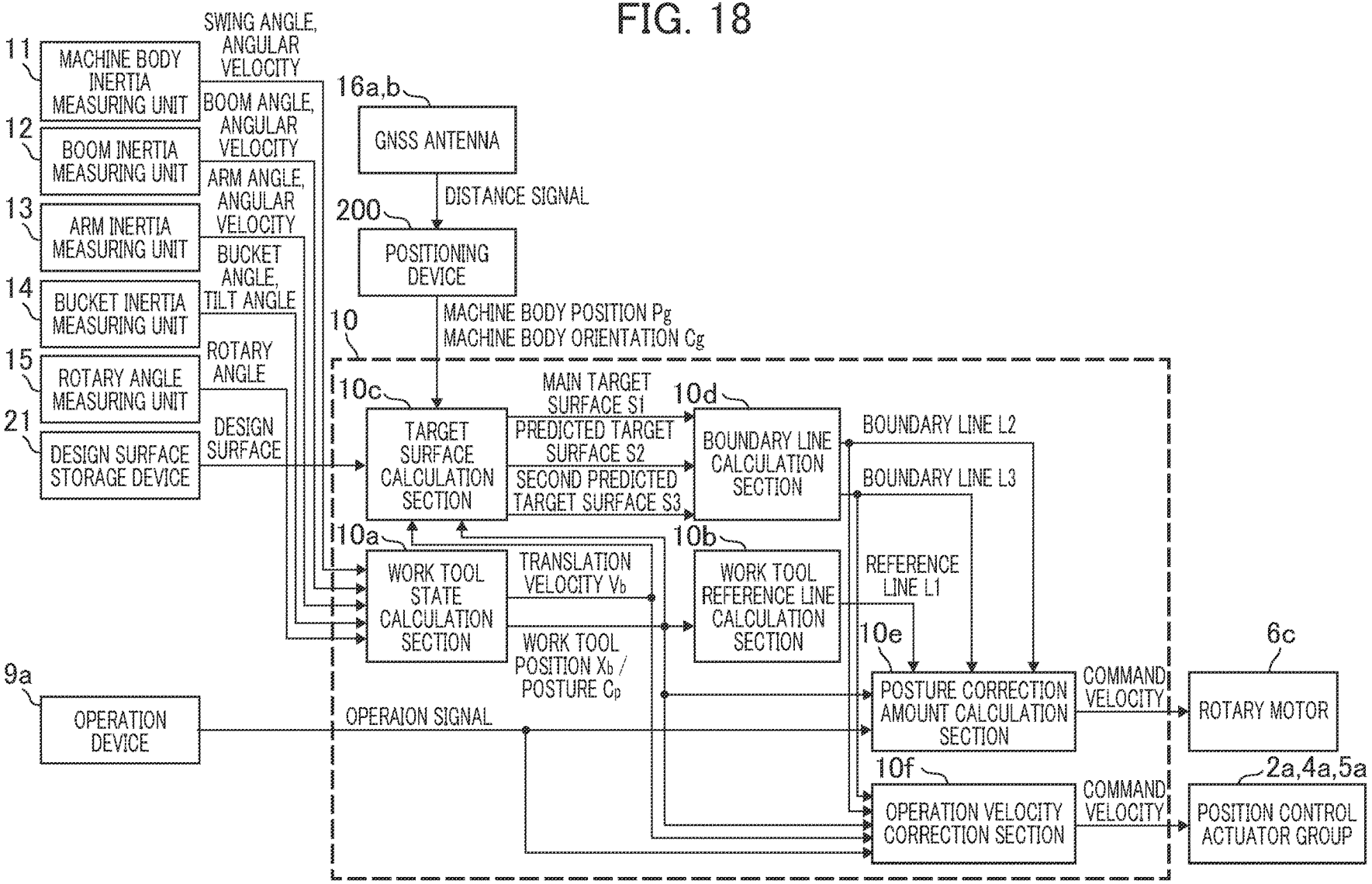
FIG. 18 is a functional block diagram depicting the details of processing functions of a controller according to a sixth embodiment.

FIG. 18 is a functional block diagram depicting the details of a processing function of a controller 10 according to a sixth embodiment.

The controller 10 has a posture correction amount calculation section 10*e* that calculates and issues a command velocity $\omega_{y,\ ref}$ to the rotary motor 6*c*, on the basis of the position $X_b$ and posture $C_b$ of the work tool 6, the reference line L1, boundary lines L2 and L3, and an operation signal, and an operation velocity correction section 10*f* that calculates and issues, as a command, a required work tool velocity $V_{b,\ req}$, on the basis of the position $X_b$, the posture $C_b$ and moving velocity $V_b$ of the work tool 6, the reference line L1, the boundary line L2 and an operation signal.

Figure 19:
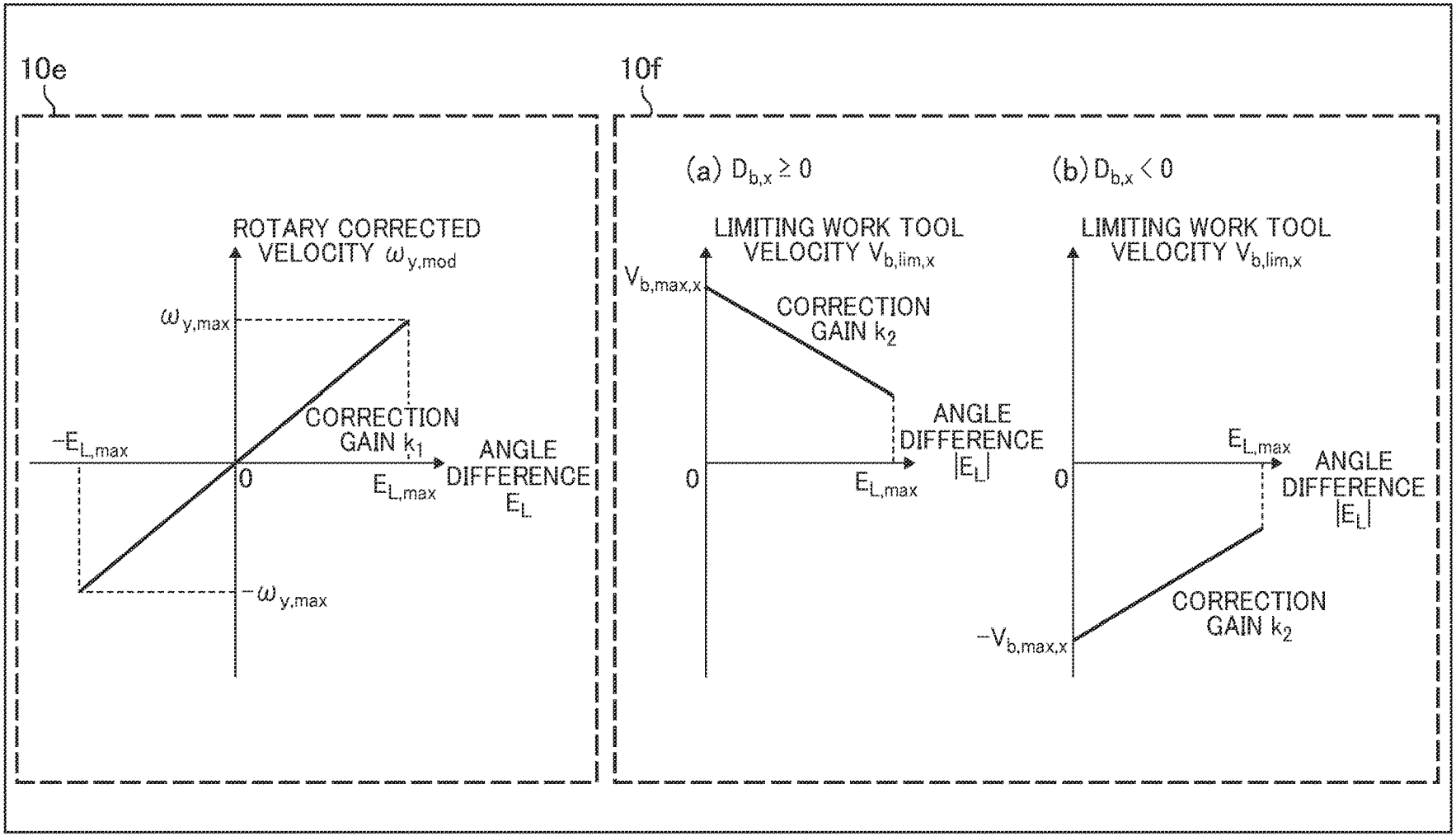
FIG. 19 is diagram depicting an example of a command conversion map between a posture correction amount calculation section and an operating velocity correction section according to the sixth embodiment.

FIG. 19 is a diagram depicting an example of a command conversion map of the posture correction amount calculation section 10*e* and the operation velocity correction section 10*f* according to the present embodiment.

The posture correction amount calculation section 10*e* calculates a rotary corrected velocity $\omega_{y,\ mod}$ according to the angular difference $E_L$ between the reference line L1 and the boundary line L2 and the formula (2). The correction gain kJ in the formula (3) is, for example, determined in the manner of the following formula (9) such that the corrected velocity of the rotary motor 6*c* becomes a maximum velocity $\omega_{y,\ max}$ at the maximum angular difference $E_{L,\ max}$ of the angle formed between the reference line L1 and the boundary line L2.

[Math 9]

$$k_1 = \frac{\omega_{y,max}}{E_{L,max}} \tag{9}$$

With the correction gain kJ determined as the formula (9), the time required for correction of the posture $C_b$ of the work tool 6 is minimized, and the frequency of generation of velocity limiting of the moving velocity $V_b$ of the work tool 6 for compensating for the line contact with the predicted target surface S2 is minimized, thus work efficiency is enhanced.

The operation velocity correction section 10*f* calculates a limited work tool velocity $V_{b,\ lim}$, according to the angular difference $E_L$ between the reference line L1 and the boundary line L2, the boundary line approaching direction vector $D_b$ and the formula (4). As an example, a conversion map for determining a limited work tool velocity $V_{b,\ lim,\ x}$ in the x direction is depicted in FIG. 19. As depicted in FIG. 19(*a*), when x component $D_{b,\ x}$ of the boundary line approaching direction vector $D_b$ is positive, the limited work tool velocity $V_{b,\ lim,\ x}$ limits the moving velocity $V_b$ of the work tool 6 only in a positive direction. On the other hand, as depicted in FIG. 19(*b*), when the x component $D_{b,\ x}$ of the boundary line approaching direction vector $D_b$ is negative, the limited work tool velocity $V_{b,\ lim,\ x}$ limits the moving velocity $V_b$ of the work tool 6 only in a negative direction. The correction gain $k_2$ in the formula (4) is determined from the following formula (10), such that the correction of the posture $C_b$ is completed before the passage through the boundary line L2, in a case, for example, in which the distance between the reference point P1 on the work tool 6 and the boundary line L2 is $T_{D1}$ and in which the angle formed between the reference line L1 and the boundary line L2 is the maximum angular difference $E_{L,\ max}$.

[Math 10]

$$k_z = \frac{k_1 T_{D1} - V_{b,max,x}}{E_{L,max}} \tag{10}$$

In addition, a distance threshold $T_{D1}$ is determined so as to satisfy the condition of the following formula (11).

[Math 11]

$$T_{D1} > \frac{V_{b,max,x}}{k_1} \tag{11}$$

With the correction gain $k_2$ and the distance threshold $T_{D1}$ determined as the formulas (10) and (11), the moving velocity $V_b$ of the work tool 6 is limited such that the correction of the posture $C_b$ of the work tool 6 is completed before passage through the boundary line L2, thus maintenance of the line contact state with the predicted target surface S2 can be ensured more securely.

Figure 20:
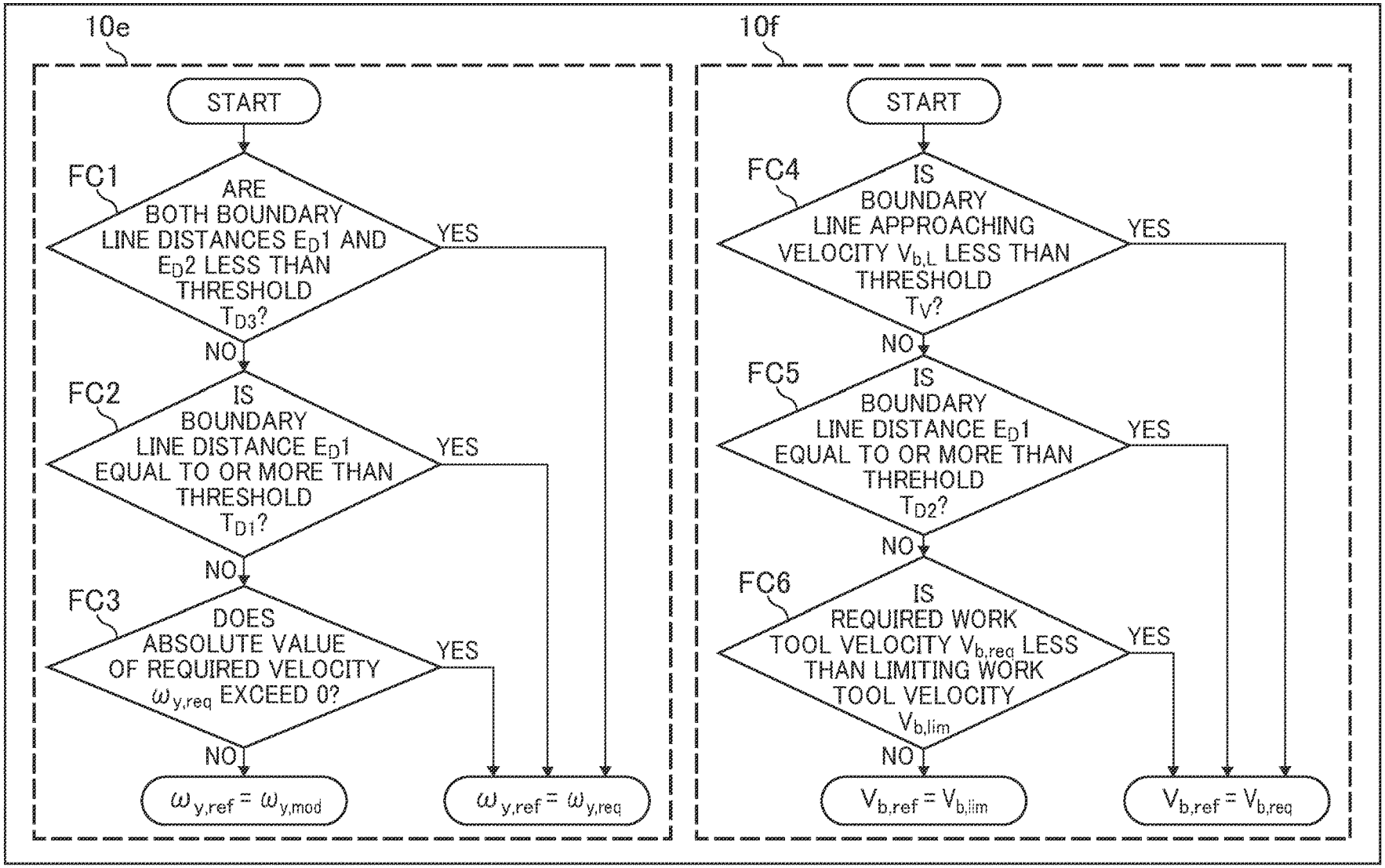
FIG. 20 is a flow chart depicting calculation processing performed by the posture correction amount calculation section and the operating velocity correction section according to the sixth embodiment.

FIG. 20 is a flow chart depicting a calculation processing performed by the posture correction amount calculation section 10*e* and the operation velocity correction section 10*f* according to the present embodiment.

The posture correction amount calculation section 10*e* selects which one of the rotary required velocity $\omega_{y,\ req}$ and the rotary corrected velocity $\omega_{y,\ mod}$ is issued as the rotary command velocity $\omega_{y,\ ref}$, on the basis of a conditional branch FC1, a conditional branch FC2 and a conditional branch FC3. The conditional branch FC1 performs a conditional branch according to the formula (8), on the basis of the boundary line distance $E_D$1 and the boundary line distance $E_D$2. The conditional branch FC2 performs a conditional branch according to the formula (5), on the basis of the boundary line distance $E_D$1. The conditional branch FC3 performs a conditional branch according to the absolute value of the rotary required velocity $\omega_{y,\ req}$.

The operation velocity correction section 10*f* selects which one of the required work tool velocity $V_{b,\ req}$ and the limited work tool velocity $V_{b,\ lim}$ is to be issued as the command work tool velocity $V_{b,\ ref}$, on the basis of a conditional branch FC4, a conditional branch FC5 and a conditional branch FC6. The conditional branch FC4 performs a conditional branch according to the formula (7), on the basis of the boundary line approaching velocity $V_{b,\ L}$. The conditional branch FC5 performs a conditional branch according to the formula (6), on the basis of the boundary line distance $E_D$1. The conditional branch (6) performs a conditional branch according to the formula (4), on the basis of the angular difference $E_L$ between the reference line L1 and the boundary line L2 and the boundary line approaching direction vector $D_b$.

According to the hydraulic excavator 100 according to the present embodiment as above, the effects described in the first to fifth embodiments are obtained.

While the embodiments of the present invention have been described in detail above, the present invention is not limited to the above embodiments, and includes various modifications. For example, although an electric lever has been used as the operation lever device in the above embodiments, a pilot-type operation lever may be used. In that case, a proportional solenoid valve is interposed between a pilot valve operated by an operation lever and a control valve for controlling the flow of a hydraulic working oil flowing into a specific actuator (a boom cylinder or an arm cylinder), to perform control. In addition, the above embodiments are described in detail for easily understandably explaining the present invention, and the invention is not necessarily limited to those which include all the configurations described. Besides, to the configuration of an embodiment, part of the configuration of other embodiment may be added, or part of the configuration of an embodiment may be removed, or may be replaced with part of other embodiment.

DESCRIPTION OF REFERENCE CHARACTERS

1: Front device
2: Upper swing structure
2*a*: Swing motor (Position control actuator)
3: Lower track structure
3*a*: Track motor (Actuator)
4: Boom
4*a*: Boom cylinder (Position control actuator)
4*a*1: Bottom-side oil chamber
4*a*2: Rod-side oil chamber
5: Arm
5*a*: Arm cylinder (Position control actuator)
6: Bucket (Work tool)
6*a*: Bucket cylinder (Actuator)
6*b*: Tilt cylinder (Actuator)
6*c*: Rotary motor (Posture control actuator)
7: Hydraulic pump
7*a*: Variable displacement pump solenoid proportional pressure reducing valve
8: Control valve
8*a*1: Swing directional control valve
8*a*2*a*, 8*a*2*b*: Solenoid proportional pressure reducing valve
8*a*3: Boom directional control valve
8*a*4*a*, 8*a*4*b*: Solenoid proportional pressure reducing valve
8*a*5: Arm directional control valve
8*a*6*a*, 8*a*6*b*: Solenoid proportional pressure reducing valve
8*a*7: Solenoid proportional pressure reducing valve
8*a*8*a*, 8*a*8*b*: solenoid proportional pressure reducing valve
8*a*9: Tilt directional control valve
8*a*10*a*, 8*a*10*b*: Solenoid proportional pressure reducing valve
8*a*11: Rotary directional control valve
8*a*12*a*, 8*a*12*b*: Solenoid proportional pressure reducing valve
8*b*1: Bleed-off valve
8*b*2: Bleed-off valve solenoid proportional pressure reducing valve
9: Cab
9*a*, 9*b*: Operation lever device (Operation device)
10: Controller
10*a*: Work tool state calculation section
10*b*: Work tool reference line calculation section
10*c*: Target surface calculation section
10*d*: Boundary line calculation section
10*e*: Posture correction amount calculation section
10*e*1: Angular difference calculation section
10*e*2: Boundary line distance calculation section
10*f*: Operation velocity correction section
10*f*1: Required work tool velocity calculation section
10*f*2: Boundary line approaching direction calculation section
10*f*3: Angular difference calculation section
10*f*4: Work tool velocity limiting section
10*f*5: Limited actuator velocity calculation section
10*f*6: Boundary line distance calculation section
10*f*7: Boundary line approaching velocity calculation section
11: Machine body inertia measuring unit
12: Boom inertia measuring unit
13: Arm inertia measuring unit
14: Bucket inertia measuring unit
15: Rotary angle measuring device
16*a*, 16*b*: GNSS antenna
21: Design surface storage deice
40: Prime mover
70: Pilot pump
100: Hydraulic excavator (Work machine)
200: Positioning device

The invention claimed is:

1. A work machine comprising:

a bucket;

a plurality of actuators including at least one position control actuator that controls a position of the bucket and at least one posture control actuator that controls posture of the bucket;

an operation device that instructs the plurality of actuators about operations of the actuators;

a controller that outputs a control signal for controlling at least one of the plurality of actuators on a basis of an operation amount of the operation device; and a design surface storage device that stores information concerning design surfaces including a plurality of target surfaces, the controller being configured to extract a first target surface which is a target surface nearest to the bucket, from among the plurality of target surfaces, and control an operation velocity of at least one actuator of the plurality of actuators on a basis of the position and posture of the bucket relative to the first target surface, wherein the posture control actuator is a rotary motor that rotates the bucket, and when the bucket is moved along the first target surface with a cutting edge of the bucket in a line contact state with the first target surface by controlling the position control actuator on a basis of an operation amount of the operation device for the position control actuator, the controller is configured to:

extract a second target surface which is a target surface adjacent to the first target surface, from among the plurality of target surfaces, calculate a first boundary line which is a boundary line between the first target surface and the second target surface, calculate an angular difference between a reference line and the first boundary line, the reference line being set as a straight line passing through a left end point and a right end point of the cutting edge of the bucket, and prior to the cutting edge of the bucket passing the first boundary line, correct a rotational angle of the rotary motor such that the angular difference becomes small and thereby the reference line comes into the line contact state with the second target surface after passing the first boundary line.

2. The work machine according to claim 1, wherein the controller is configured to, when correcting the rotational angle of the rotary motor, correct the control signal for the position control actuator such that degree of deceleration of an operating velocity of the bucket on a direction toward the first boundary line is larger as the angular difference is larger.

3. The work machine according to claim 1, wherein the controller is configured to calculate a first boundary line distance which is a distance from a reference point set on the cutting edge of the bucket to the first boundary line, and when the first boundary distance is less than a threshold, correct the rotational angle of the rotary motor such that the angular difference becomes small.

4. The work machine according to claim 1, wherein the controller is configured to calculate a first boundary line distance which is a distance from a reference point set on the cutting edge of the bucket to the first boundary line, and when the first boundary line distance is less than a threshold, correct the control signal for the position control actuator such that a moving velocity of the bucket becomes equal to or less than a limited velocity.

5. The work machine according to claim 1, wherein the controller is configured to calculate a boundary line approaching velocity which is a velocity component in a direction toward the first boundary line of an operating velocity of the bucket, and when the boundary line approaching velocity is equal to or more than a threshold, correct the control signal for the position control actuator such that a moving velocity of the bucket becomes equal to or less than a limited velocity.

6. The work machine according to claim 1, wherein the controller is configured to extract a third target surface which is a target surface adjacent to the first target surface separately from the second target surface, from among the plurality of target surfaces, calculate a second boundary line which is a boundary line between the first target surface and the third target surface, calculate a first boundary line distance which is a distance from a reference point set on the cutting edge of the bucket to the first boundary line, calculate a second boundary line distance which is a distance from the reference point to the second boundary line, and when both the first boundary line distance and the second boundary line distance are less than a threshold, stop correction of the rotational angle of the rotary motor.

* * * * *